US007784870B2

(12) United States Patent
Machael et al.

(10) Patent No.: US 7,784,870 B2
(45) Date of Patent: Aug. 31, 2010

(54) SIX BAR MECHANISM AND CONTROL FOR CHAIR

(75) Inventors: Jay R. Machael, Muscatine, IA (US); Jesse Hahn, Cedar Rapids, IA (US); Keith Machin, Wyoming, MI (US); Richard Neil Roslund, Jr., Jenison, MI (US)

(73) Assignee: HNI Technologies, Inc., Muscatine, IA (US)

( * ) Notice: Subject to any disclaimer, the term of this patent is extended or adjusted under 35 U.S.C. 154(b) by 0 days.

(21) Appl. No.: 12/048,116

(22) Filed: Mar. 13, 2008

(65) Prior Publication Data

US 2008/0309135 A1 Dec. 18, 2008

Related U.S. Application Data

(60) Provisional application No. 60/894,653, filed on Mar. 13, 2007.

(51) Int. Cl.
*A47C 1/024* (2006.01)
*A47C 1/038* (2006.01)
*A47C 3/026* (2006.01)

(52) U.S. Cl. ..... 297/300.5; 297/300.6; 297/300.7; 297/300.8; 297/301.4; 297/301.5; 297/301.6; 297/301.7

(58) Field of Classification Search ..... 297/300.5, 297/300.6, 300.7, 300.8, 301.4, 301.5, 301.6, 297/301.7
See application file for complete search history.

(56) References Cited

U.S. PATENT DOCUMENTS 4,411,469 A 10/1983 Drabert et al.
4,521,053 A * 6/1985 de Boer ..... 297/312
4,684,173 A * 8/1987 Locher ..... 297/300.3
4,695,093 A * 9/1987 Suhr et al. ..... 297/303.4
4,761,033 A 8/1988 Lanuzzi et al.
4,765,679 A * 8/1988 Lanuzzi et al. ..... 297/300.3
4,773,706 A * 9/1988 Hinrichs ..... 297/300.5
5,249,839 A 10/1993 Faiks et al.
5,282,670 A * 2/1994 Karsten et al. ..... 297/301.6 X
5,348,367 A 9/1994 Mizelle
5,385,388 A 1/1995 Faiks et al.

(Continued)

FOREIGN PATENT DOCUMENTS

WO 2006119209 A2 11/2006

OTHER PUBLICATIONS

International Search Report and Written Opinion for PCT/US2008/056892 of HNI Technologies Inc., mailed Jul. 17, 2008.

(Continued)

*Primary Examiner*—Rodney B White
(74) *Attorney, Agent, or Firm*—Faegre & Benson LLP

(57) ABSTRACT

A chair according to embodiments of the present invention includes a base; a first linkage pivotably coupled to the base, a seat pivotably coupled to the first linkage, a second linkage pivotably coupled to the seat and pivotably coupled to the base, a back comprising a substantially upright portion and an attachment portion, the attachment portion pivotably coupled to the base at a first pivot point, and a third linkage pivotably coupled to the back at a second pivot point and pivotably coupled to the second linkage, wherein the second pivot point is on the attachment portion between the first pivot point and the substantially upright portion.

26 Claims, 33 Drawing Sheets

U.S. PATENT DOCUMENTS 5,577,807 A * 11/1996 Hodge et al. ..... 297/300.8 X
5,725,276 A 3/1998 Ginat
5,931,531 A 8/1999 Assmann
5,997,094 A 12/1999 Cvek
6,616,228 B2 9/2003 Heidmann
6,669,294 B2 12/2003 Kinoshita et al.
6,739,664 B2 5/2004 Kinoshita et al.
6,805,405 B2 10/2004 Koo
6,811,218 B2 * 11/2004 Deimen et al. ..... 297/316 X
6,817,667 B2 11/2004 Pennington et al.
6,905,171 B2 6/2005 Knoblock et al.
6,913,316 B2 7/2005 Kinoshita et al.
6,959,965 B2 11/2005 Diffrient
6,969,116 B2 * 11/2005 Machael et al. ..... 297/300.2
7,000,987 B2 2/2006 Staarink
7,080,884 B2 * 7/2006 Daeschle et al. ..... 297/300.8 X
7,097,249 B2 8/2006 Igarashi et al.
7,114,770 B2 10/2006 Murphy
7,147,282 B2 * 12/2006 Hatcher et al. ..... 297/300.2 X
7,273,253 B2 * 9/2007 Deimen et al. ..... 297/300.4
7,467,826 B1 * 12/2008 Wen ..... 297/300.8 X
2001/0000939 A1 5/2001 Roslund, Jr. et al.
2003/0127896 A1 * 7/2003 Deimen et al. ..... 297/301.1
2003/0137171 A1 * 7/2003 Deimen et al. ..... 297/300.1 X
2005/0231013 A1 10/2005 Knoblock et al.
2006/0071523 A1 4/2006 Stumpf et al.
2006/0175884 A1 8/2006 Jenkins

OTHER PUBLICATIONS

Norton, Robert L., Design of Machinery: An Introduction to the Synthesis and Analysis of Mechanisms and Machines, McGraw Hill (3rd Ed. 2003), pp. 47-49.

* cited by examiner

SECTION A-A

SECTION B-B

SIX BAR MECHANISM AND CONTROL FOR CHAIR

CROSS-REFERENCE TO RELATED APPLICATIONS

This application claims the benefit of U.S. Provisional Patent Application Ser. No. 60/894,653, filed on Mar. 13, 2007, and entitled, "Six Bar Mechanism and Control for Chair," which is incorporated by reference herein in its entirety.

TECHNICAL FIELD

Embodiments of the present invention relate generally to office furniture, and more specifically to a six bar mechanism for chair movement and control therefor.

BACKGROUND

Current reclining chair designs often do not effectively match movement of a user with movement of the chair parts. For example, some chairs feature a reclining seat back coupled with a stationary seat, which does not permit the user's spine to conform to a natural position when reclining. As another example, in a reclining office chair governed by a typical four bar linkage, the seat back and the seat often apply a shear force to the user because the lower body undergoes translation in a direction with respect to the upper body which does not conform to a natural translation during reclination. This shear force may often be sufficient to cause the user's shirt to become untucked, for example.

In addition, most reclining office chairs include a pre-load component used to create resistance as the user reclines the seat back. Such pre-load components often serve as a hindrance to the easy adjustment of the resistance device, often because the force necessary to adjust the resistance is high due to the preload or requires large displacement (e.g. in the form of many turns of a knob). Those without a high level of manual dexterity or strength may find difficulty in adjusting the resistance on such high pre-load chairs.

SUMMARY

A chair according to embodiments of the present invention includes a base, a first linkage pivotably coupled to the base, a seat pivotably coupled to the first linkage, a second linkage pivotably coupled to the seat and pivotably coupled to the base, a back comprising a substantially upright portion and an attachment portion, the attachment portion pivotably coupled to the base at a first pivot point, and a third linkage pivotably coupled to the back at a second pivot point and pivotably coupled to the second linkage, wherein the second pivot point is on the attachment portion between the first pivot point and the substantially upright portion. According to some embodiments of the present invention, the back reclines about the first pivot point, and the chair includes a biasing element configured to apply a resistance force about the first pivot point, the resistance force resisting a reclining force of the back. The resistance force may be adjustable by varying a location along the biasing element at which the reclining force is applied. The biasing element may be a coil spring, such as, for example, a coil spring placed coaxially with the first pivot point. The coil spring may include a lever arm, such that the resistance force is adjustable by varying a location along the lever arm at which the reclining force is applied to the coil spring. A slider may be configured to transmit the reclining force from the back to the lever arm, and the slider slides substantially horizontally along the lever arm, such that a sliding force for sliding the slider is substantially less than the resistance force.

In some instances, the slider slides between a locked position and an unlocked position, and the slider in the locked position substantially prevents reclining of the back about the base. The slider in the locked position may be in a position closest to the seat. The chair may include a cable sheath with first and second ends and which is coupled to the base, and a cable extending through the cable sheath and slidable within the cable sheath, a first portion of the cable extending from the first end of the cable sheath, the first portion coupled to the slider, and a second portion of the cable extending from the second end of the cable sheath, wherein sliding the second portion into and out of the cable sheath slides the slider back and forth along the lever arm.

A chair according to such embodiments may further include a button coupled to the second portion and configured to slide the second portion into and out of the cable sheath. The lever may be mounted to the seat at a location, such as a location directly below the seat on a user's left or right side when the user sits in the seat. According to some embodiments of the present invention, the base, the seat, the back, and the first, second, and third linkages comprise a Watts sixbar inversion 11 mechanism. According to some embodiments of the present invention, the seat is configured to move upwardly and toward the back when the back reclines about the base.

When the back reclines about the base from a fully upright position to a fully reclined position, a centrode of the back with respect to the seat remains above the seat, according to embodiments of the present invention. The centrode substantially coincides with a hip point of a user sitting in the chair as the back reclines from the fully upright position to the fully reclined position, according to embodiments of the present invention.

A chair according to alternative embodiments of the present invention includes a base, a first linkage pivotably coupled to the base at a first pivot point, a seat pivotably coupled to the first linkage at a second pivot point, a second linkage pivotably coupled to the seat at a third pivot point and pivotably coupled to the base at a fourth pivot point, a back pivotably coupled to the base at a fifth pivot point, and a third linkage pivotably coupled to the back at a sixth pivot point and pivotably coupled to the second linkage at a seventh pivot point, wherein the second and third pivot points are closer to the seat than each of the first, fourth, fifth, sixth, and seventh pivot points. According to such embodiments, the back reclines about the base from a fully upright position to a fully reclined position, and a centrode of the back with respect to the seat remains above the seat as the back reclines from the fully upright position to the fully reclined position. The centrode substantially coincides with a hip point of a user sitting in the chair as the back reclines from the fully upright position to the fully reclined position, according to embodiments of the present invention.

A chair according to yet other embodiments of the present invention includes a base, a first linkage pivotably coupled to the base at a first pivot point, a seat pivotably coupled to the first linkage at a second pivot point, a second linkage pivotably coupled to the seat at a third pivot point and pivotably coupled to the base at a fourth pivot point, a back pivotably coupled to the base at a fifth pivot point, and a third linkage pivotably coupled to the back at a sixth pivot point and pivotably coupled to the second linkage at a seventh pivot point, wherein the third, fourth, and seventh pivot points are not substantially collinear.

A chair according to yet other embodiments of the present invention includes a base, a first linkage pivotably coupled to the base at a first pivot point, a seat pivotably coupled to the first linkage at a second pivot point, a second linkage pivotably coupled to the seat at a third pivot point and pivotably coupled to the base at a fourth pivot point, a back pivotably coupled to the base at a fifth pivot point, and a third linkage pivotably coupled to the back at a sixth pivot point and pivotably coupled to the second linkage at a seventh pivot point, wherein the back reclines about the base from a fully upright position to a fully reclined position, and wherein neither the first linkage nor the second linkage rotates over-center as the back reclines from a fully upright position to a fully reclined position. The second pivot point and the third pivot point rise vertically throughout reclining of the back from the fully upright position to the fully reclined position, according to embodiments of the present invention.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
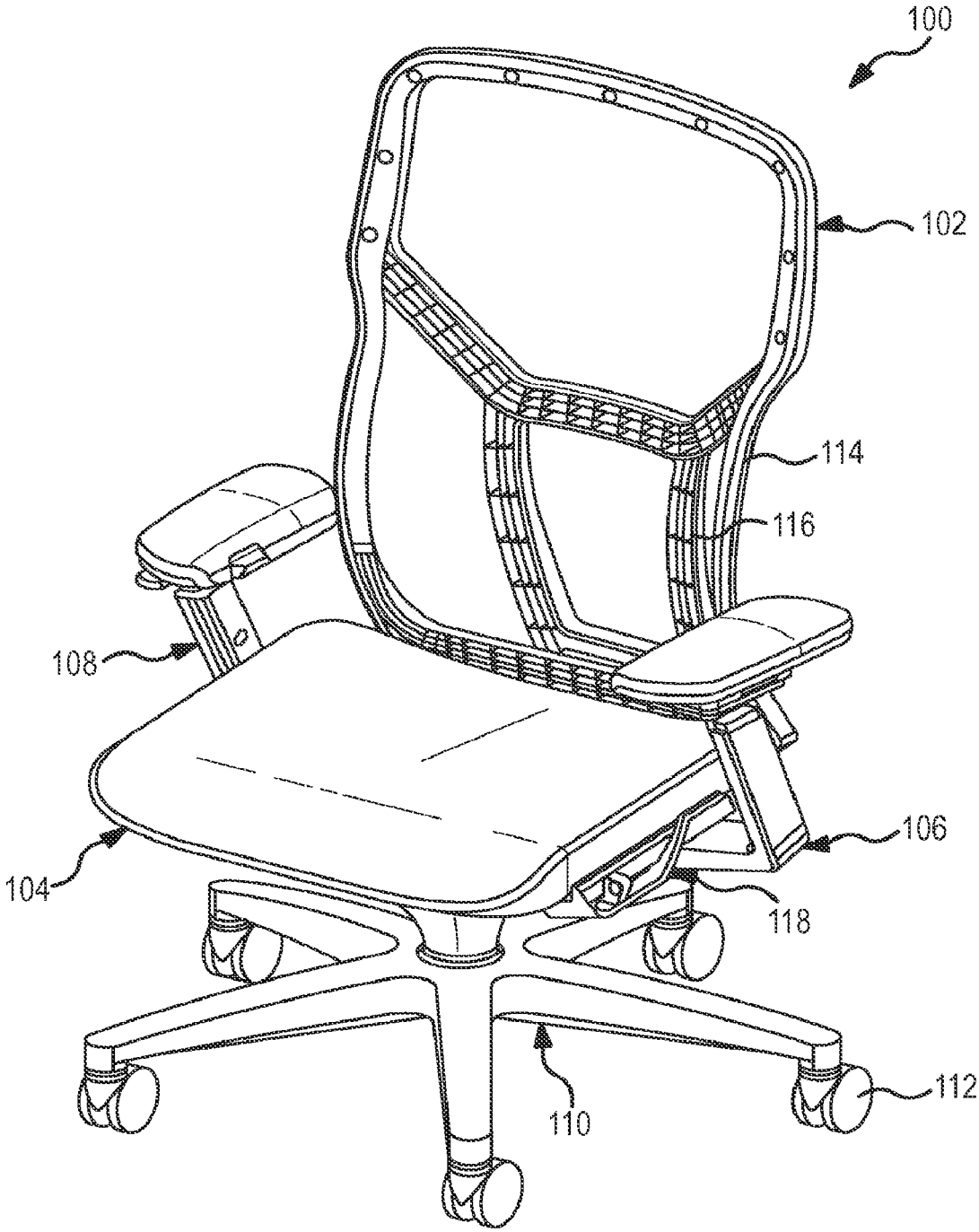
FIG. 1 illustrates a front perspective view of a chair according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention relate generally to office furniture, and more specifically to a six bar mechanism for chair movement and control therefor. FIGS. 1-7 depict a reclining office chair 100 according to embodiments of the present invention. Chair 100 includes a back 102, a seat 104, a left arm 106, a right arm 108, and a base pedestal 110. Seat 104 and back 102 of chair 100 rotate about base pedestal 110, and casters 112 or wheels may be coupled to base pedestal 110 to contact an underlying surface (such as, for example, a floor), according to embodiments of the present invention. Back 102 may include a support member 116 and a covering (not shown) made of mesh, fabric, or the like which is coupled to back 102 along outer frame 114 and against which a user's back would rest.

As used herein, the term "coupled" is used in its broadest sense to refer to elements which are connected, attached, and/or engaged, either directly or integrally or indirectly via other elements, and either permanently, temporarily, or removably. As used herein, the term "swivelably coupled" is used in its broadest sense to refer to elements which are coupled in a way that permits one element to swivel with respect to another element. As used herein, the terms "rotatably coupled" and "pivotably coupled" are used in their broadest sense to refer to elements which are coupled in a way that permits one element to rotate or pivot with respect to another element. As used herein, the term "slidably coupled" is used in its broadest sense to refer to elements which are coupled in a way that permits one element to slide or translate with respect to another element.

Figure 2:
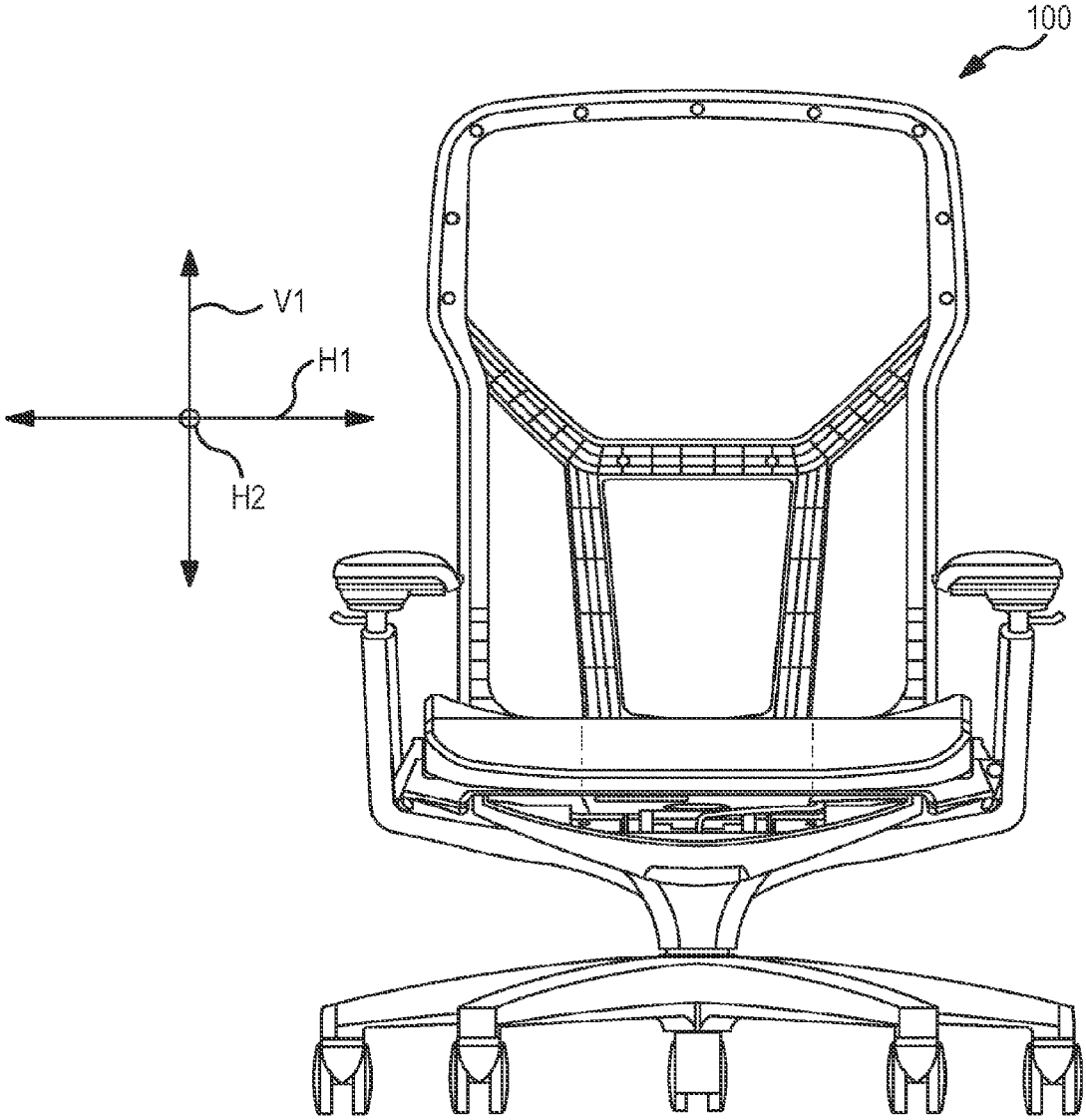
FIG. 2 illustrates front view of the chair of FIG. 1, according to embodiments of the present invention.
Figure 3:
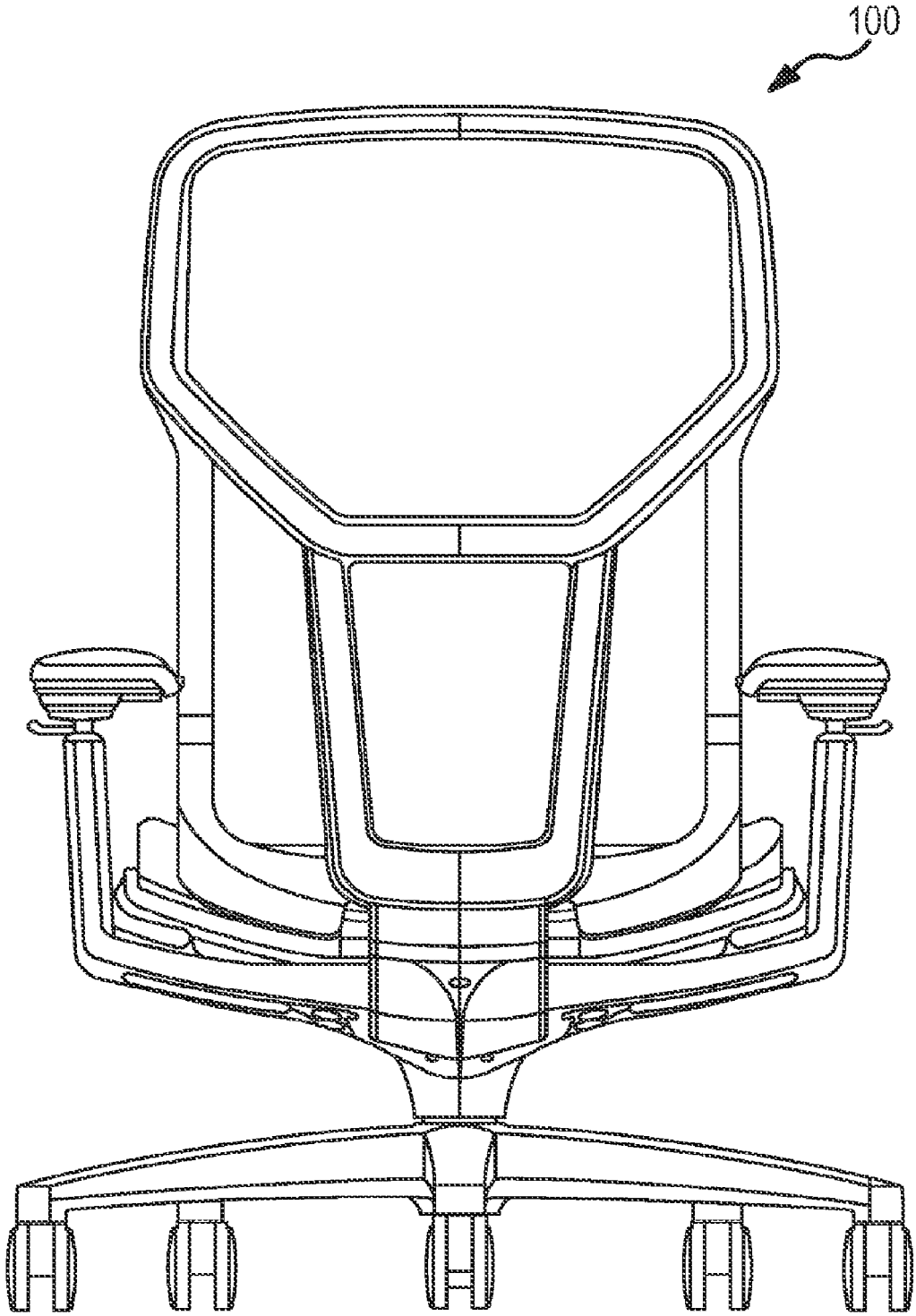
FIG. 3 illustrates back view of the chair of FIGS. 1 and 2, according to embodiments of the present invention.
Figure 5:
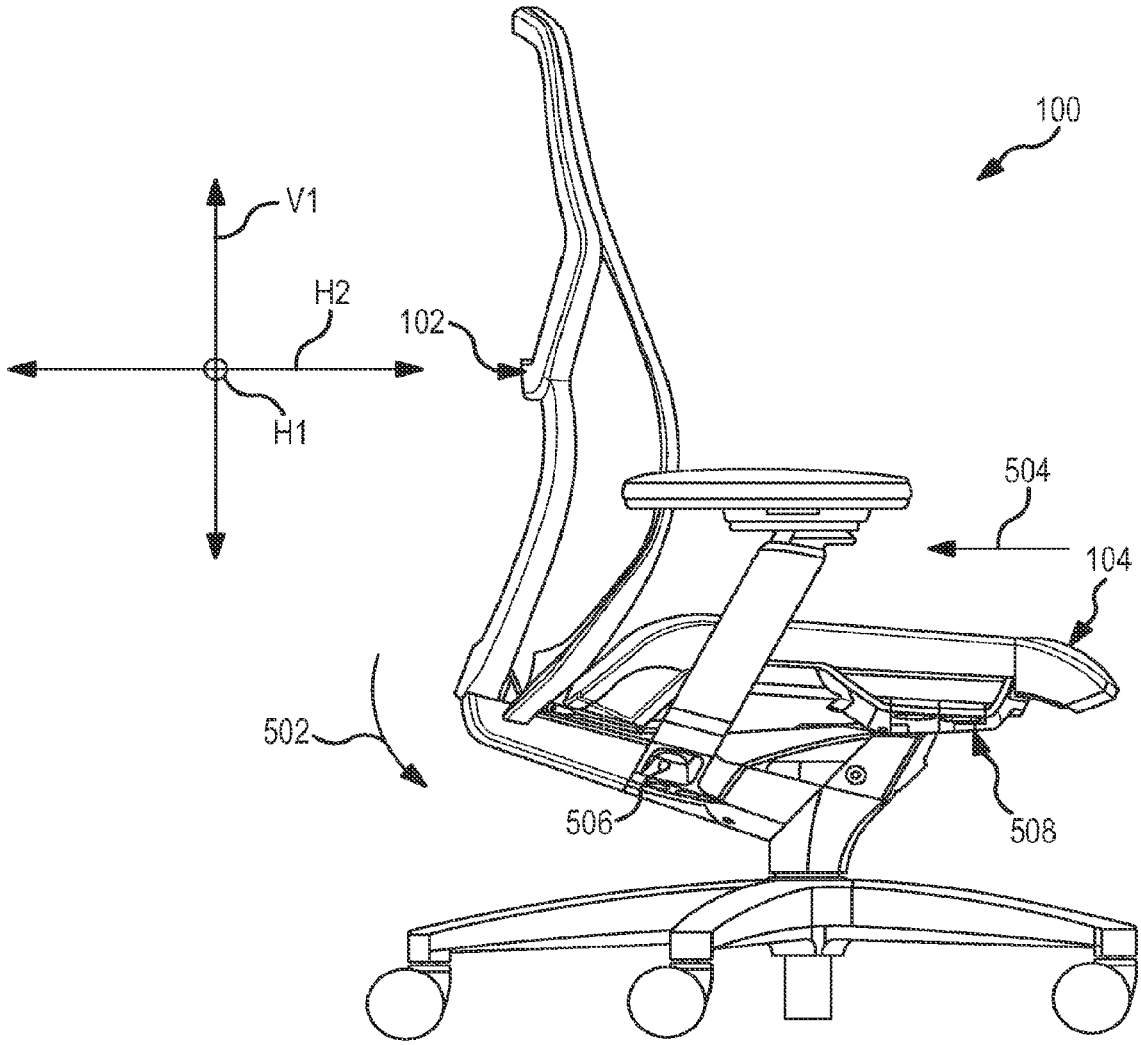
FIG. 5 illustrates another side view of the chair of FIGS. 1-4, according to embodiments of the present invention.
Figure 6:
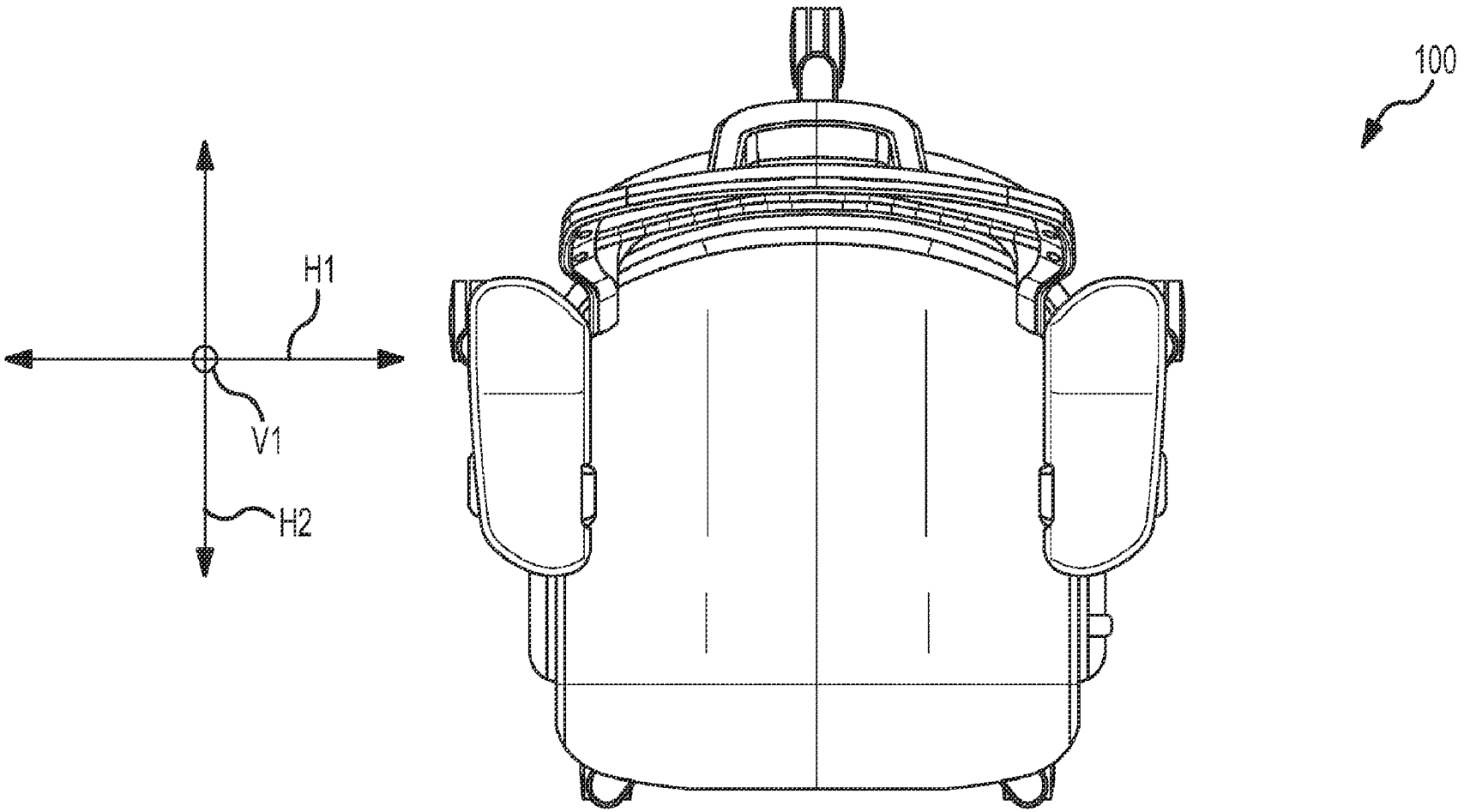
FIG. 6 illustrates a top view of the chair of FIGS. 1-5, according to embodiments of the present invention.
Figure 7:
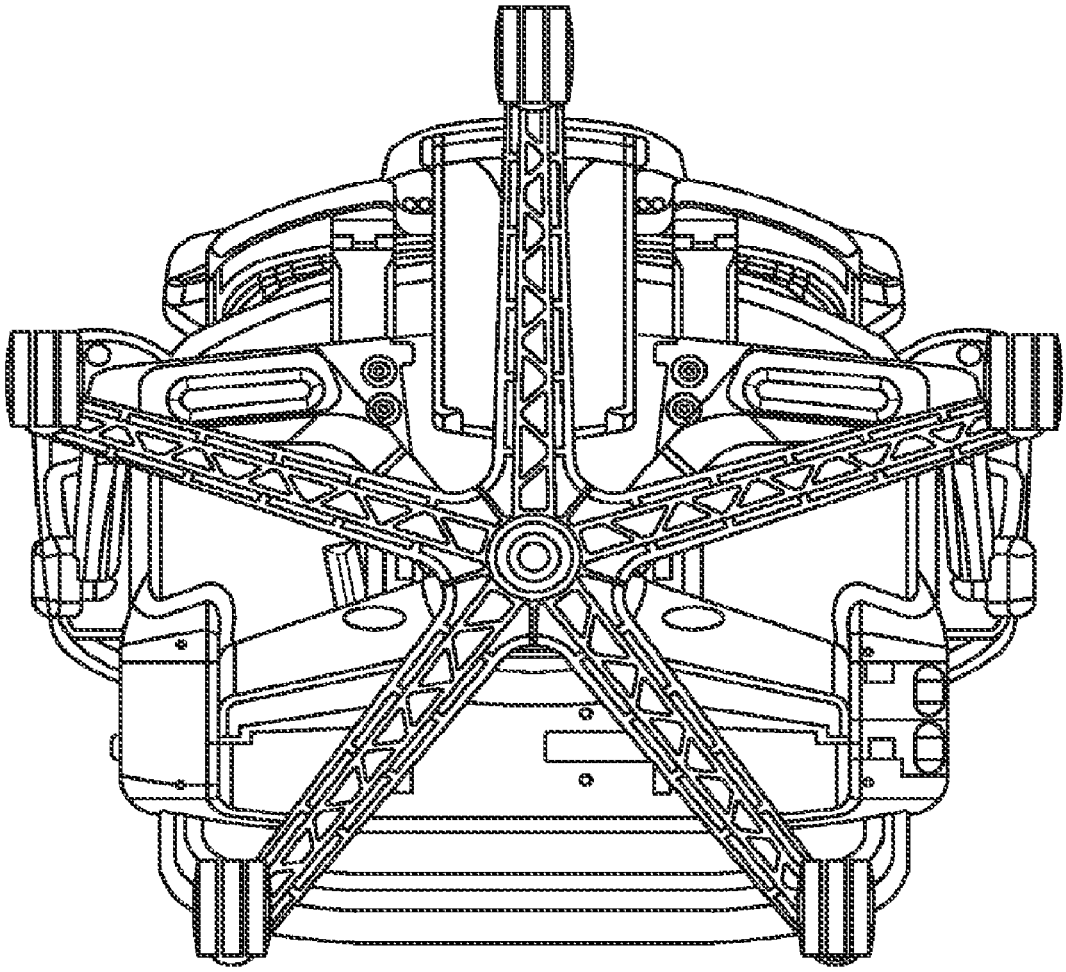
FIG. 7 illustrates a bottom view of the chair of FIGS. 1-6, according to embodiments of the present invention.

As used herein, the terms "horizontal," "horizontally," and the like are used in their broadest sense to refer to a direction along or parallel to a plane relative to a chair 100, where such plane is defined by the lines H1 and H2 depicted in FIGS. 2, 5 and 6. Although lines H1 and H2 are not shown in all views, the plane defined by H1 and H2 in FIGS. 2, 5 and 6 serves to define such plane in all views as such plane is defined relative to chair 100. As used herein, the terms "vertical," "vertically," and the like are used in their broadest sense to refer to a direction along or parallel to a line relative to a chair 100, where such line is defined by the line V1 of FIGS. 2, 5 and 6. Although line V1 is not shown in all views, line V1 serves to define such line in all views as such line is defined relative to chair 100.

As illustrated in the side view of FIG. 5, back 102 reclines and/or rotates in a direction generally indicated by arrow 502 about a pivot point generally indicated at 506, when user pushes against back 102. This rotation of back 102 in direction 502 causes seat 104 to slide generally towards the back 102 in a direction indicated by arrow 504, as well as generally upwardly. According to embodiments of the present invention, the movement of seat 104 upon reclining of back 102 is determined by the links forming a six-bar mechanism as described in more detail below. A user's upper body generally pivots with respect to the user's lower body at a point referred to as the hip point, as viewed from the side. Embodiments of the present invention seek to locate the instant center of linkages which comprise chair 100 and back 102 over the seat 104, such that a centrode characterized by the linkages more closely follows the motion of the user's hip point during the reclining process. This adds to the user's comfort during reclining by more closely matching movement of chair 100 to the movement of a user, and by minimizing often uncomfortable sliding and friction of the user's back with respect to back 102 and the user's underside with respect to seat 104 during reclining, and by minimizing misalignment of the user's back with respect to back 102.

Figure 8:
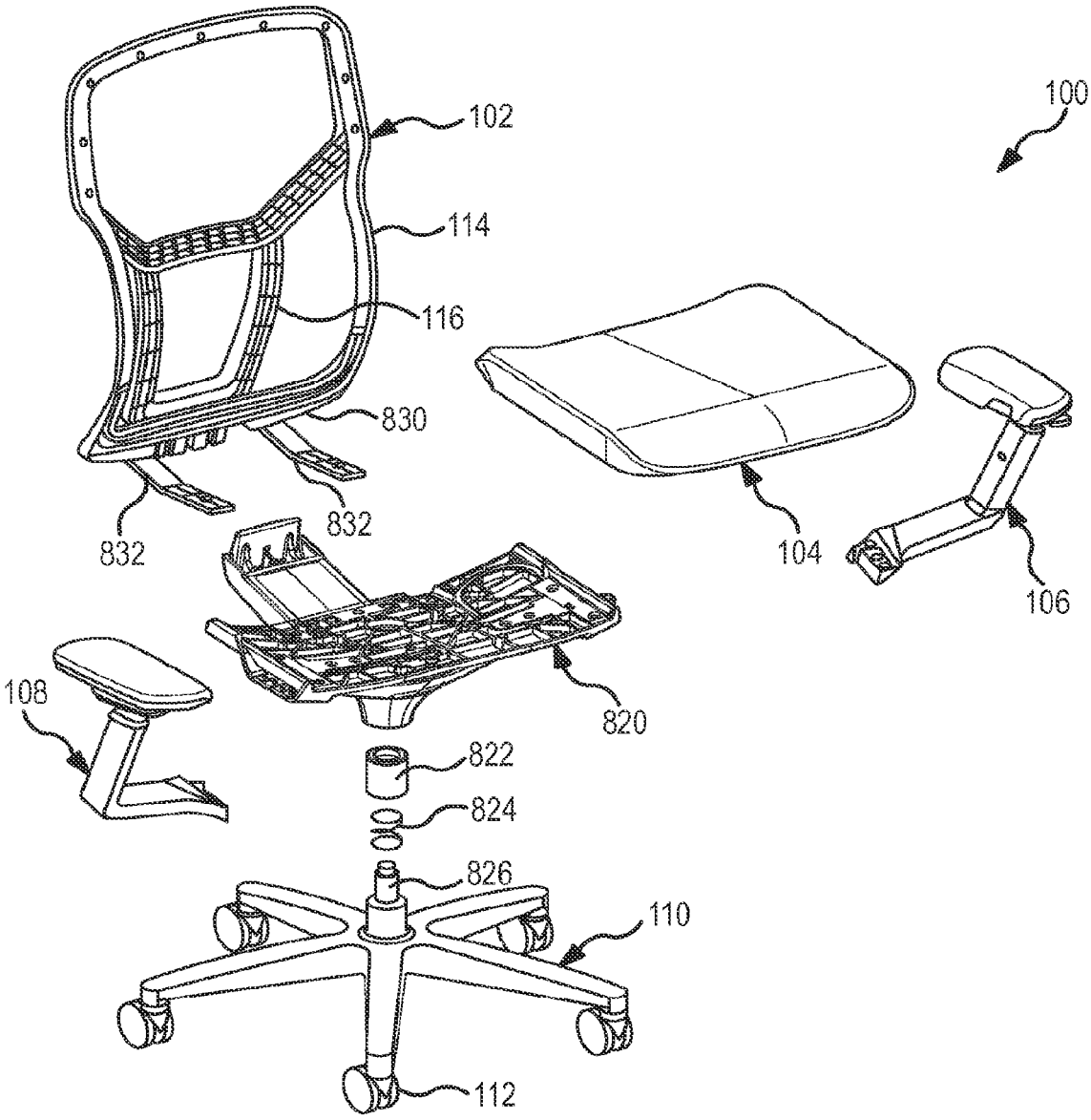
FIG. 8 illustrates an exploded perspective view of the chair of FIGS. 1-7, according to embodiments of the present invention.

FIG. 8 depicts an exploded view of chair 100 including back 102, seat 104, left arm 106, right arm 108, pedestal 110, casters 112, and core assembly 820, which are coupled to form chair 100. Core assembly 820 is coupled with pedestal 110 via a hydraulic piston 826 which permits core assembly 820 to rotate about pedestal 110 and which permits the height of core assembly 820 to be adjusted with respect to pedestal 110. Sheath 822 may be included between core assembly 820 and pedestal 110 to cover and protect hydraulic piston 826 and/or spring 824. Spring 824 may be included between core assembly 820 and pedestal 110 in order to supply an upwardly-biased force to raise sheath 822 as core assembly 820 is lifted by hydraulic piston 826, according to embodiments of the present invention.

Figure 9:
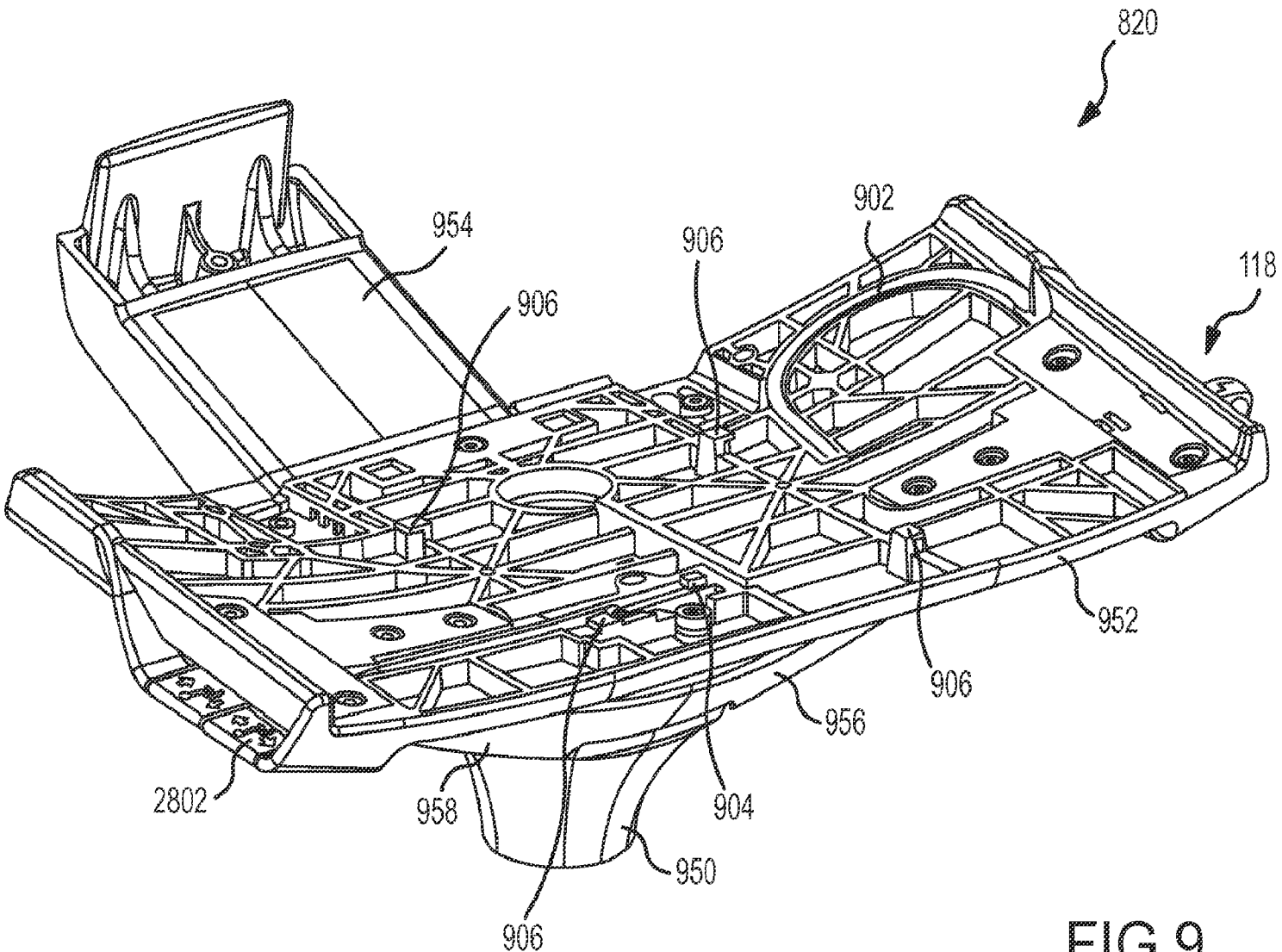
FIG. 9 illustrates an enlarged view of a core assembly, according to embodiments of the present invention.
Figure 10:
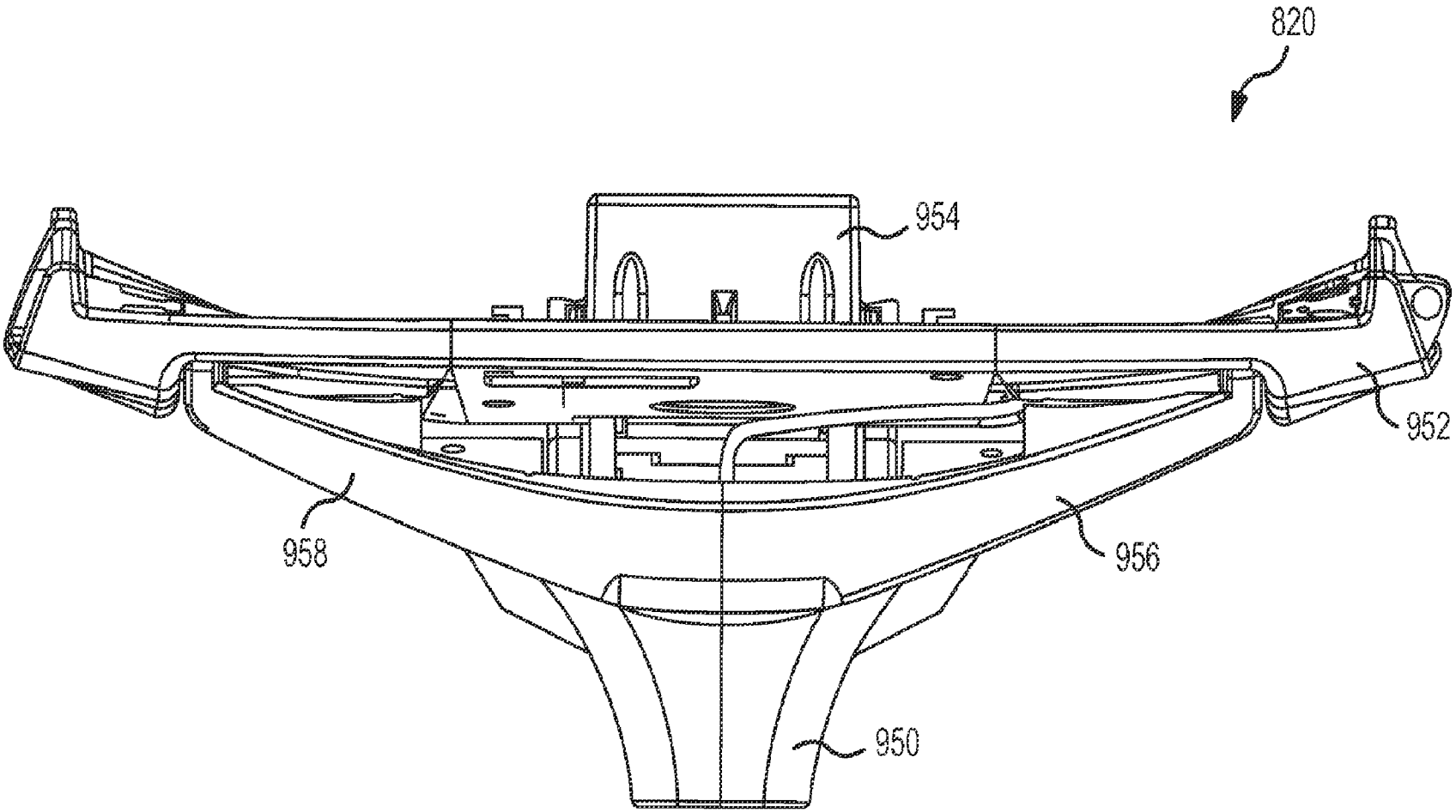
FIG. 10 illustrates a front view of the core assembly of FIG. 9, according to embodiments of the present invention.
Figure 12:
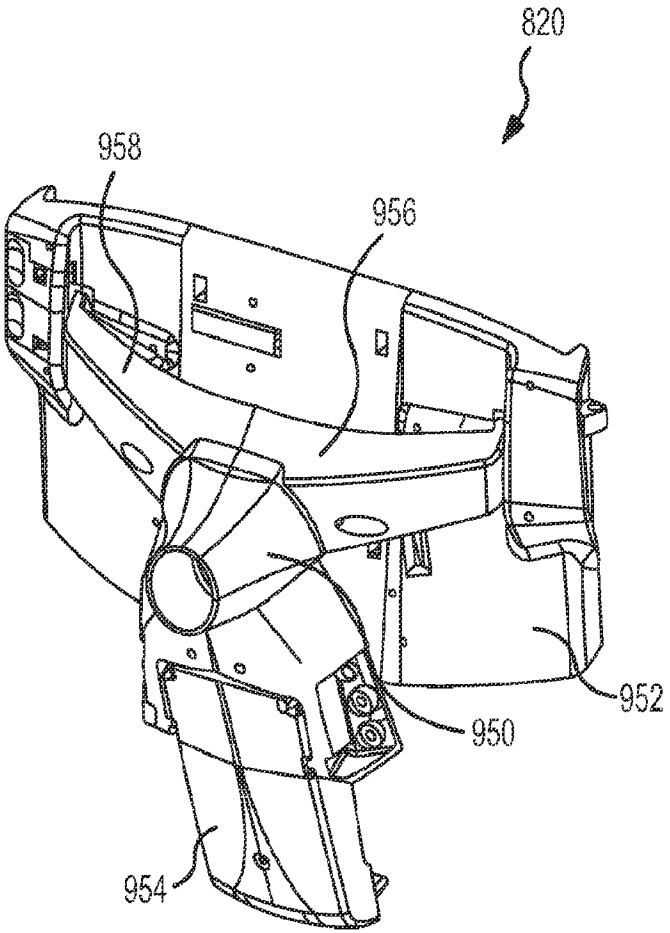
FIG. 12 illustrates a bottom perspective view of the core assembly of FIGS. 9-11, according to embodiments of the present invention.
Figure 11:
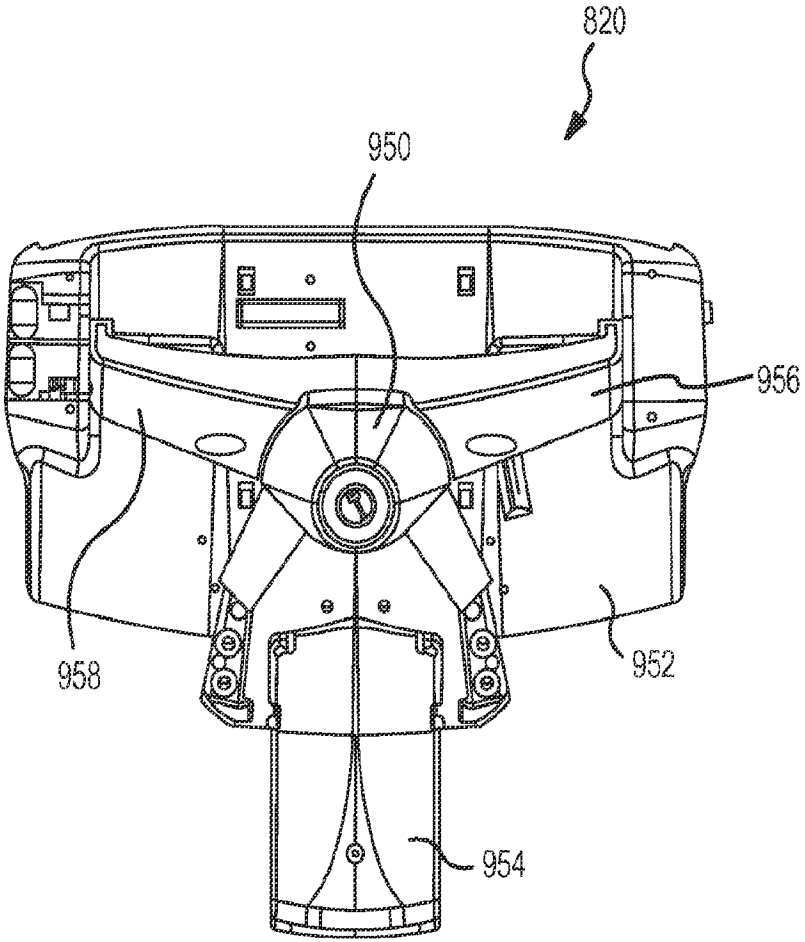
FIG. 11 illustrates a bottom view of the core assembly of FIGS. 9 and 10, according to embodiments of the present invention.

FIG. 9 illustrates an enlarged perspective view of core assembly 820 and FIG. 10 illustrates an enlarged front view of core assembly 820. FIG. 11 shows a bottom view and FIG. 12 shows a bottom perspective view of core assembly 820. According to embodiments of the present invention, core assembly 820 includes a base 950, a seat mount 952, and a reclining assembly 954. Seat mount 952 is pivotably coupled to base 950 in the front by a front left linkage 956 and a front right linkage 958, and in the back by reclining assembly 954, according to embodiments of the present invention. According to some embodiments of the present invention, the front left linkage 956 and front right linkage 958 may be a single linkage.

Figure 13:
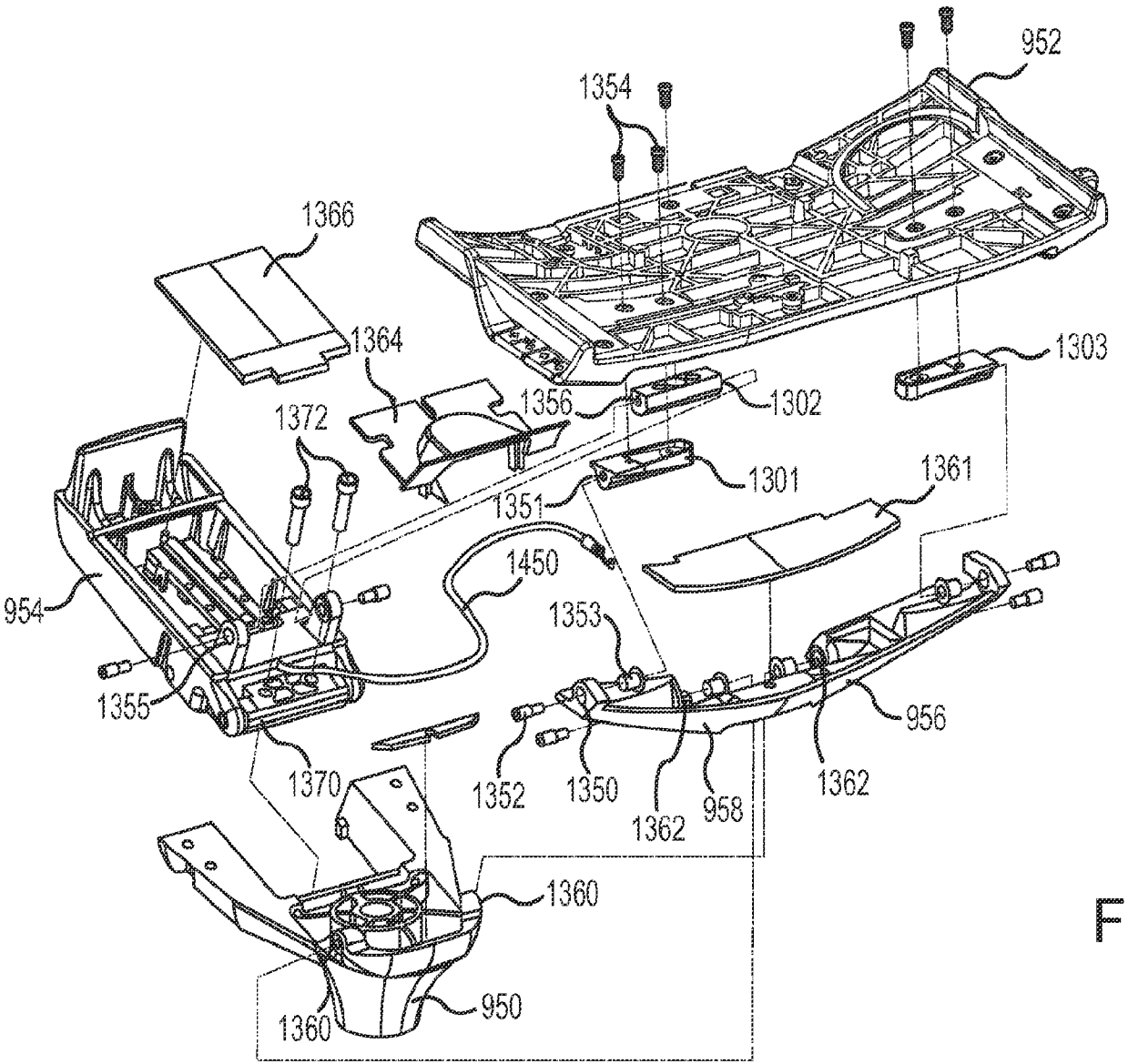
FIG. 13 illustrates an exploded perspective view of the core assembly of FIGS. 9-12, according to embodiments of the present invention.
Figure 14:
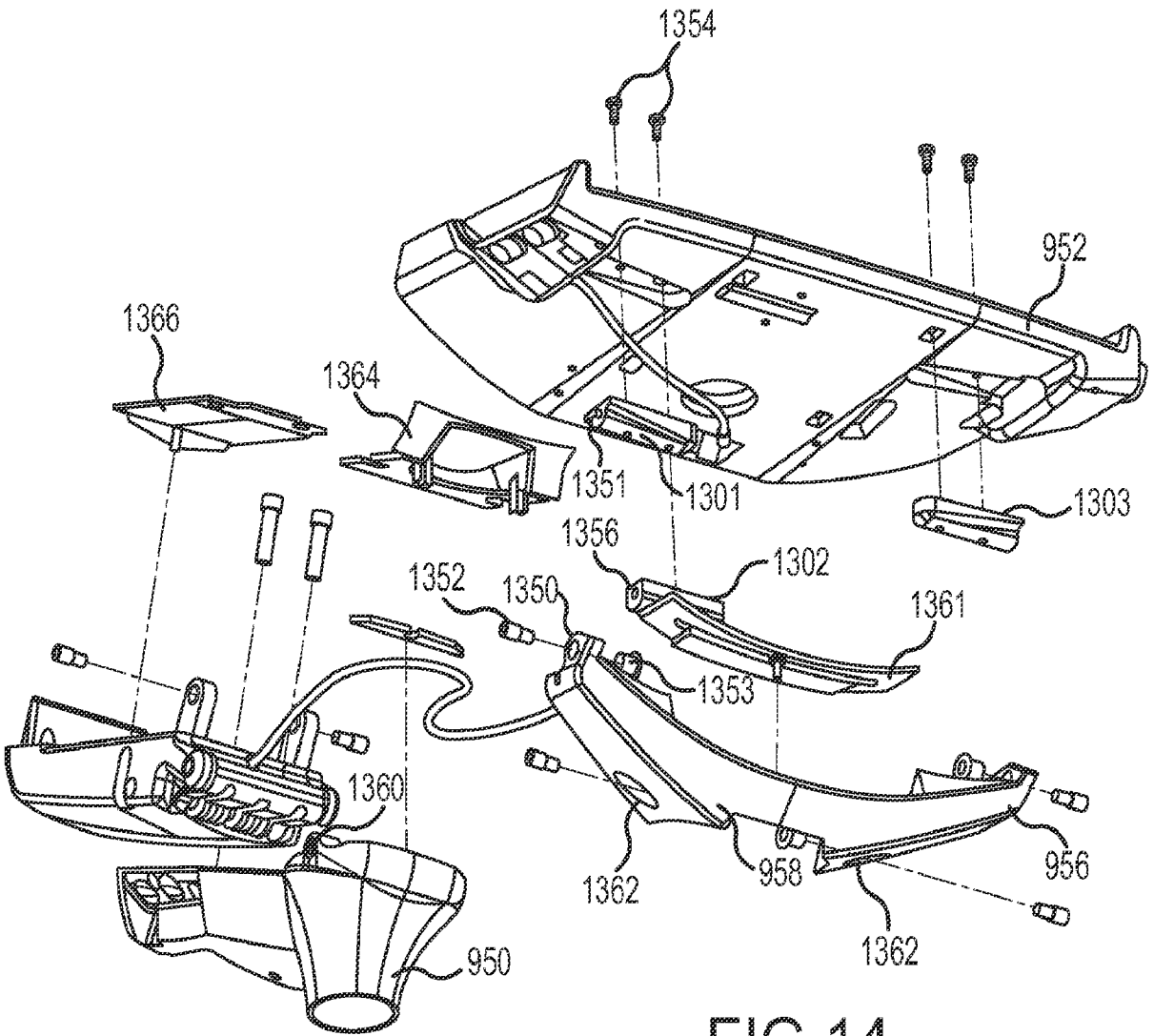
FIG. 14 illustrates another exploded perspective view of the core assembly of FIGS. 9-13, according to embodiments of the present invention.

FIGS. 13 and 14 illustrate an exploded view of core assembly 820, according to embodiments of the present invention. A front right linkage mount 1301, a front left linkage mount 1303, and a reclining assembly mount 1302 may be affixed to seat mount 952 to provide locations for the rotatable coupling of the front right linkage 958, the front left linkage 956, and the reclining assembly 954, respectively, according to embodiments of the present invention. For example, the front right linkage mount 1301 may be affixed to the seat mount 952 by screws 1354 or other fasteners as illustrated in FIG. 13. Front right linkage 958 may include an opening 1350 configured to house a bushing 1353 inserted therein and configured to accept a shaft member 1352 inserted through bushing 1353 and secured to front right linkage mount 1301 at hole 1351; for example, shaft member 1352 may be threadably secured to front right linkage mount 1301. Such a rotatable coupling permits front right linkage 958 to rotate and/or pivot about seat mount 952 about an axis that is substantially parallel to line H1 (see FIG. 2).

Similarly, front left linkage 956 may be rotatably coupled to front left linkage mount 1303 of seat mount 952, and reclining assembly 954 may be rotatably coupled to reclining assembly mount 1302 on both sides of mount 1302 (such that, on one side, opening 1355 is provided with a bushing and shaft mount secured to hole 1356), according to embodiments of the present invention. In a similar fashion, the opposite ends of front linkages 956 and 958 may be rotatably coupled with base 950 by rotatably coupling openings 1362 to locations 1360. Based on the disclosure provided herein, one of ordinary skill in the art will recognize the various ways in which the pivoting connections described herein may be made.

Various cover plates 1361, 1364, 1366 may further be employed to cover and/or protect chair 100 hardware. Although shown as a part of reclining assembly 954, base connector 1370 may be affixed to base 950 by screws 1372 or other connectors, thereby becoming a rigid and/or semi-rigid part of base 950, and about which additional pivot connections are made within reclining assembly 954, as described in more detail below according to embodiments of the present invention. Therefore, when reference is made herein about an element rotating about base 950, such a reference includes elements rotating about base connector 1370 which is affixed to and is a part of base 950, according to embodiments of the present invention.

Figure 15:
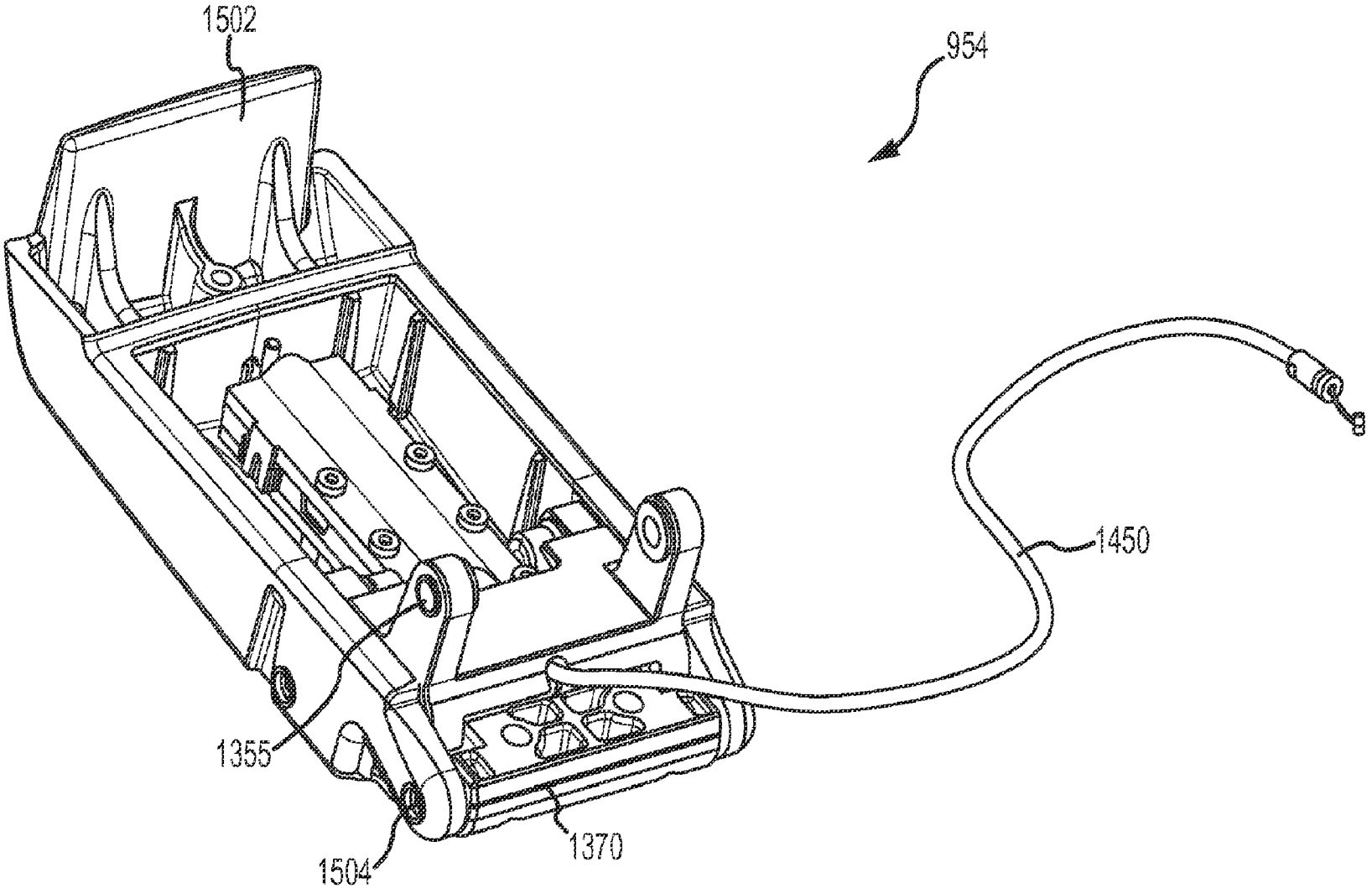
FIG. 15 illustrates a perspective view of a reclining assembly, according to embodiments of the present invention.
Figure 16:
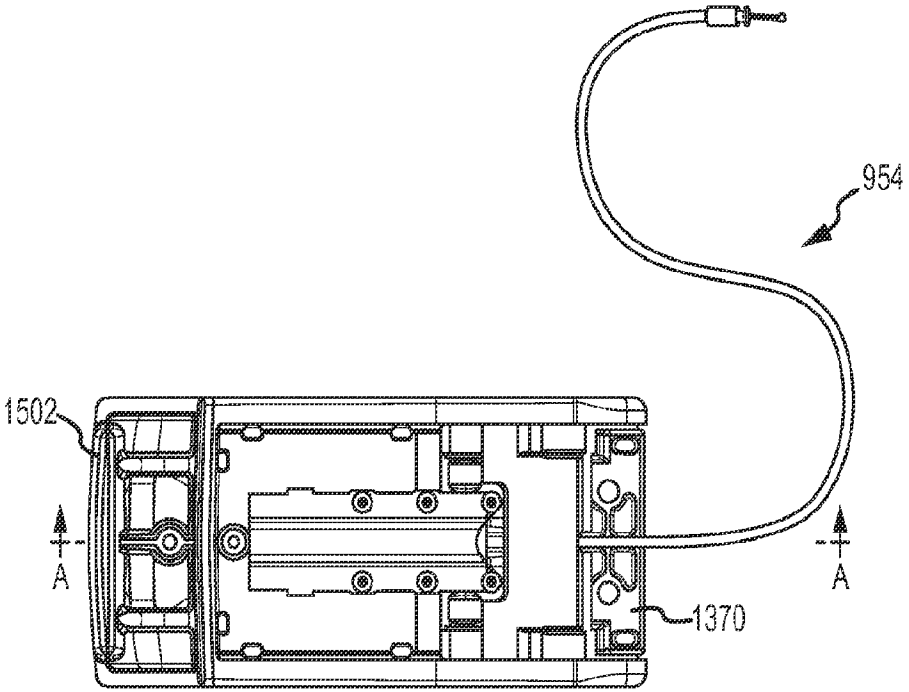
FIG. 16 illustrates a top view of the reclining assembly of FIG. 15, according to embodiments of the present invention.
Figure 17:
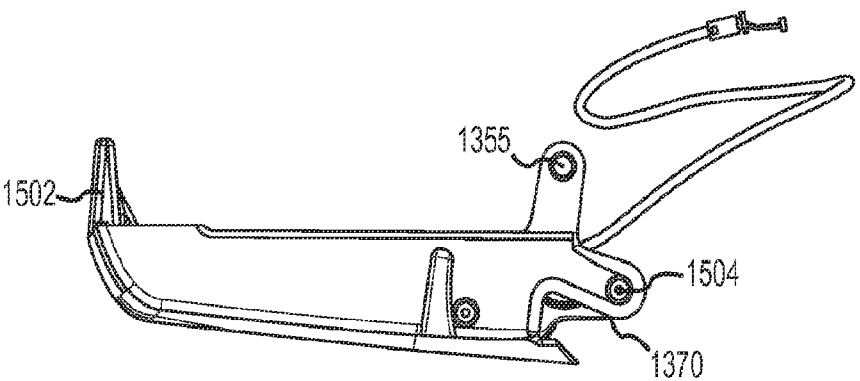
FIG. 17 illustrates a side view of the reclining assembly of FIGS. 15 and 16, according to embodiments of the present invention.

FIG. 15 depicts a front perspective view, FIG. 16 depicts a top view, and FIG. 17 depicts a side view of reclining assembly 954, according to embodiments of the present invention. Reclining assembly 954 connects to support member 116 of back 102 at back support member connector 1502, and is pivotably coupled with base connector 1370 (and thus with base 950) at pivot point 1504 and with seat mount 952 at pivot point 1355.

Figure 18A:
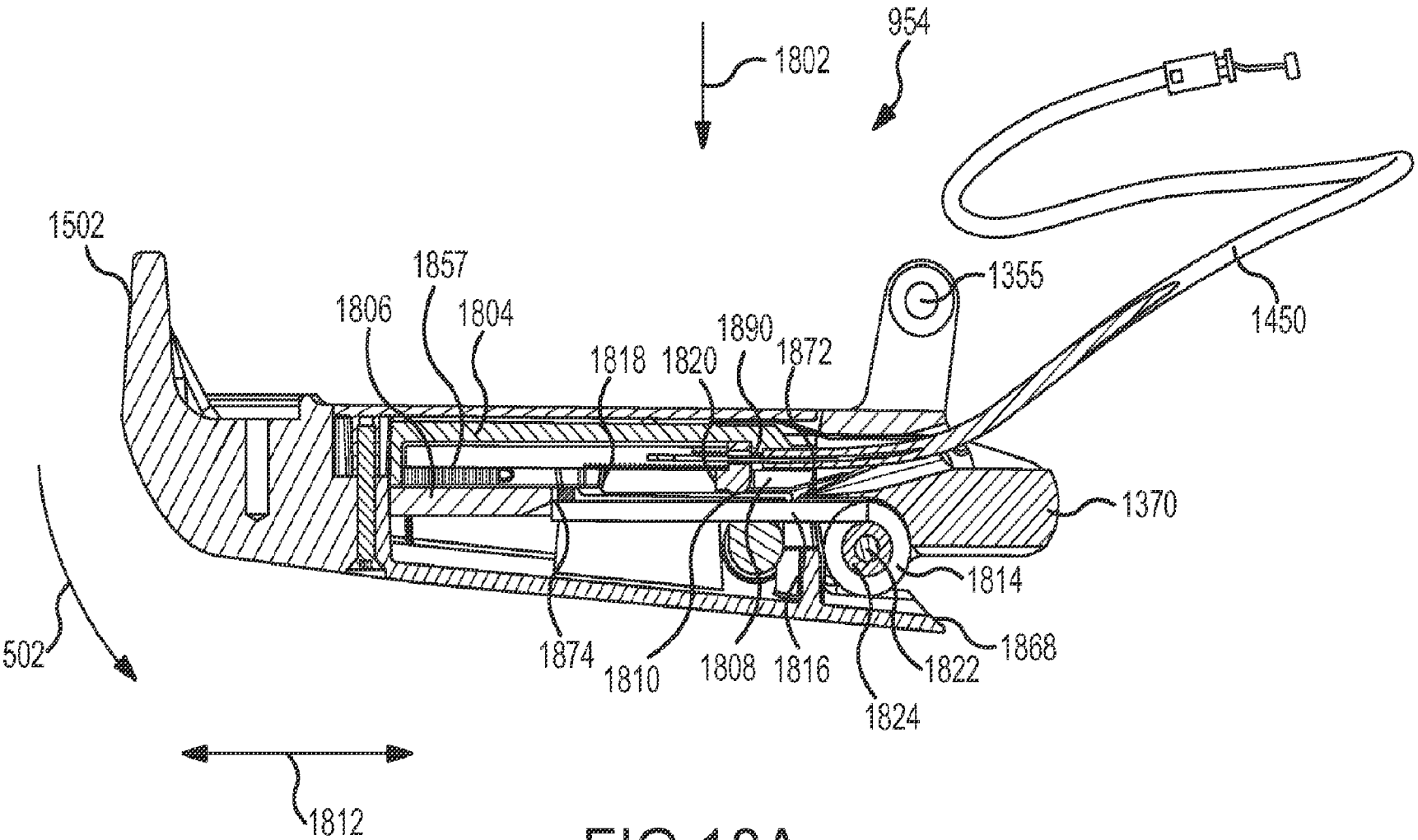
FIGS. 18A-18C illustrate a cross-sectional view of the reclining assembly of FIGS. 15-17, taken along line A-A of FIG. 16, with a slider at different positions, according to embodiments of the present invention.
Figure 18B:
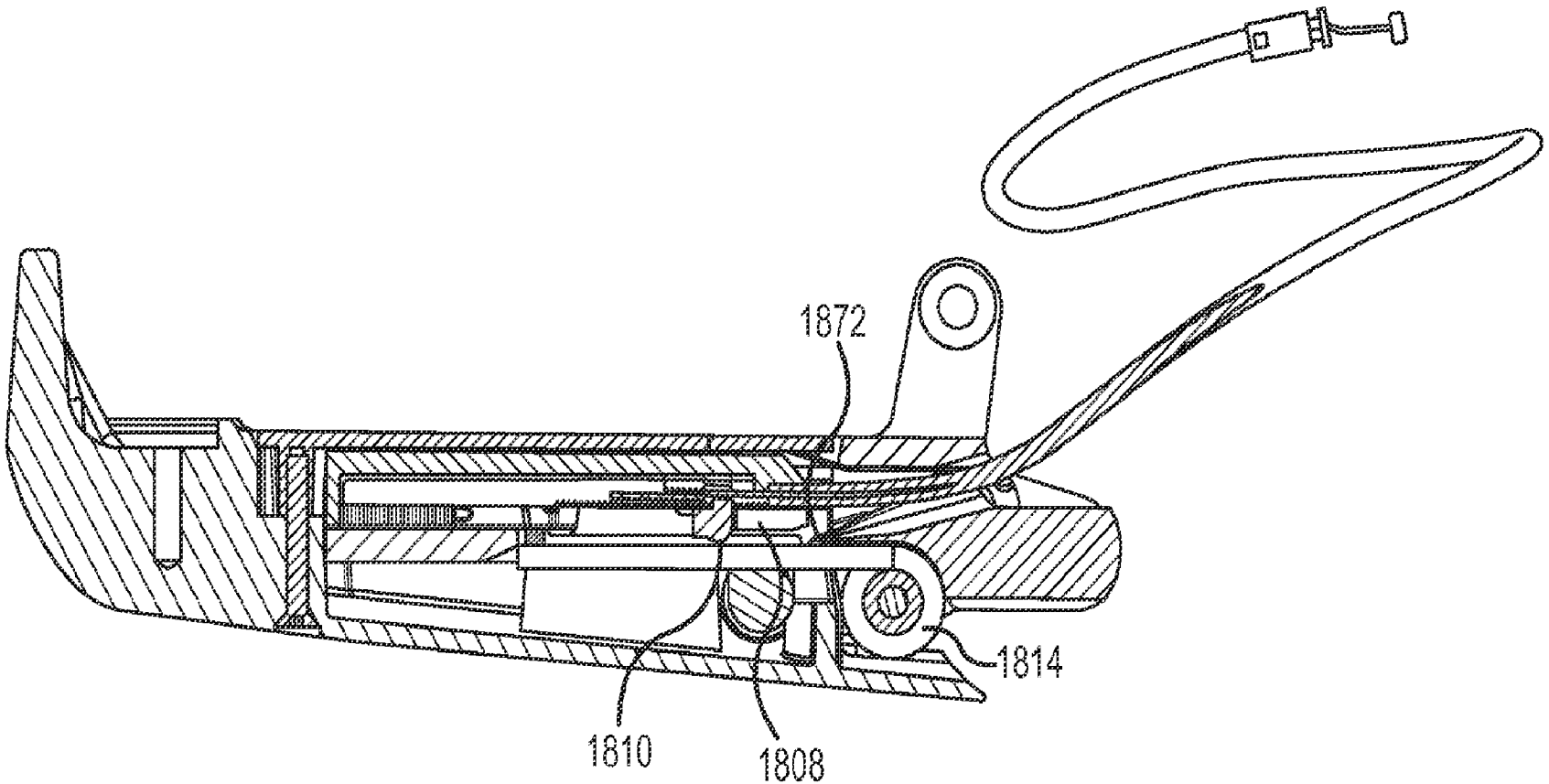
Figure 18C:
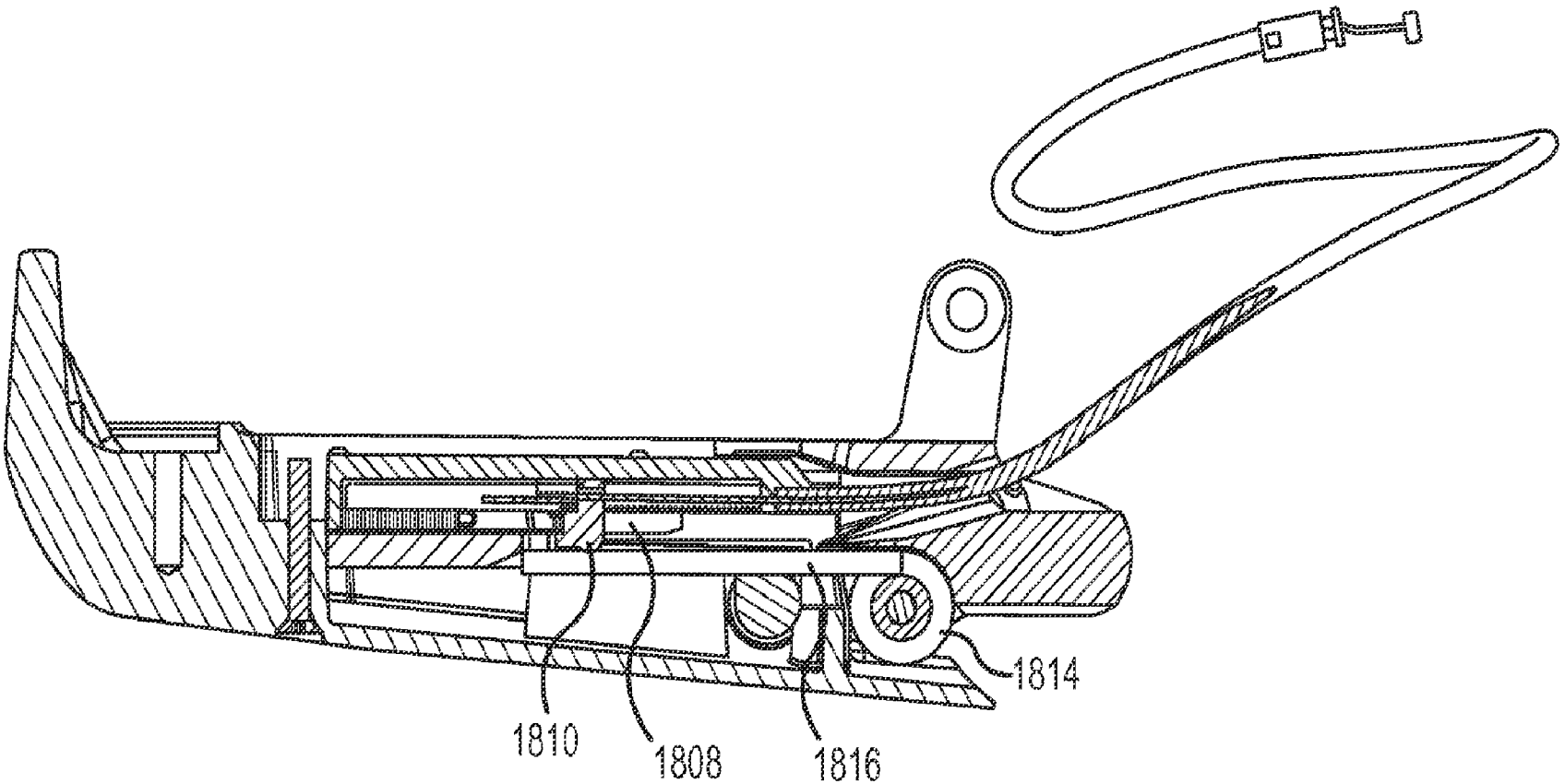
Figure 19:
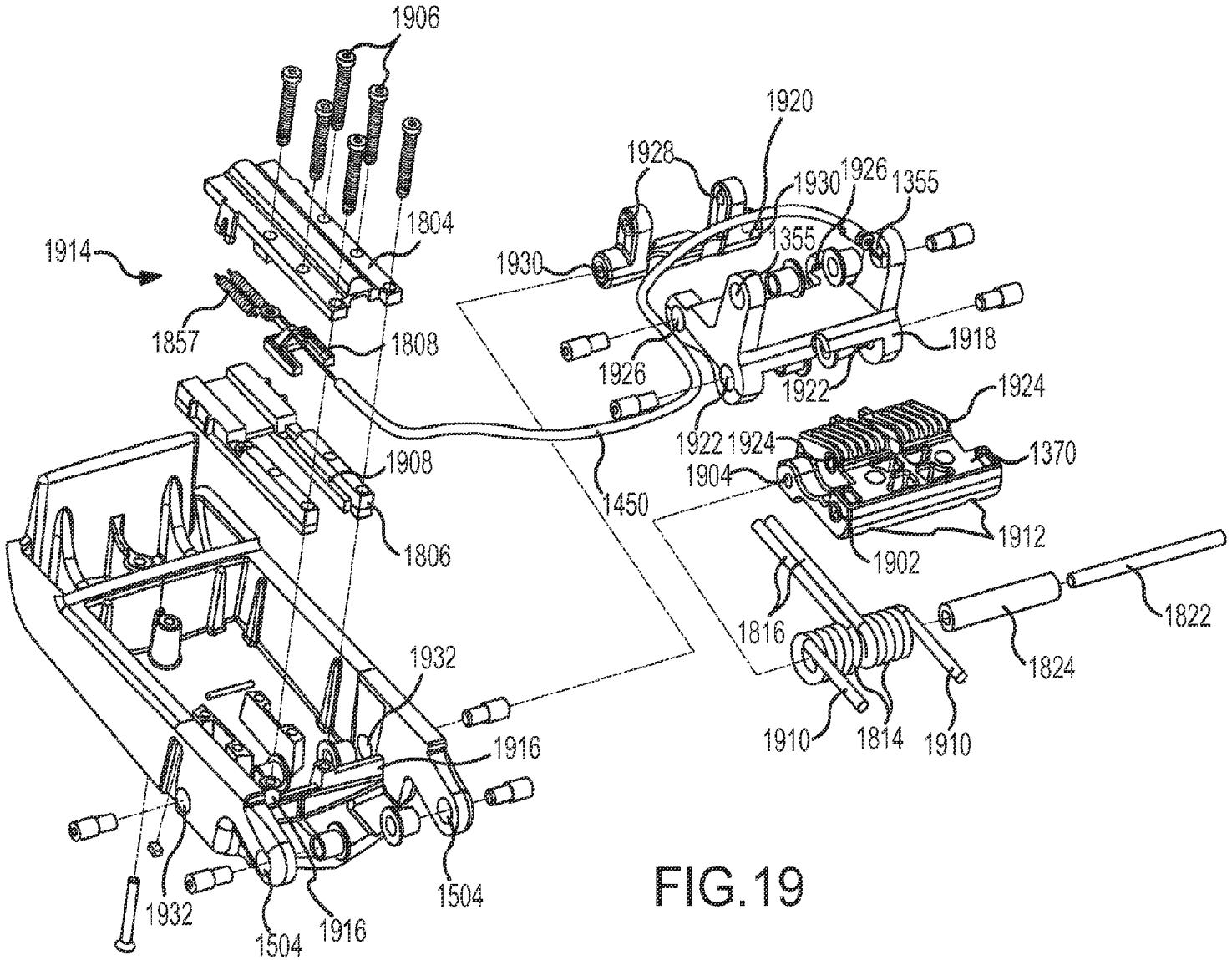
FIG. 19 illustrates an exploded perspective view of the reclining assembly of FIGS. 15-18, according to embodiments of the present invention.
Figure 20:
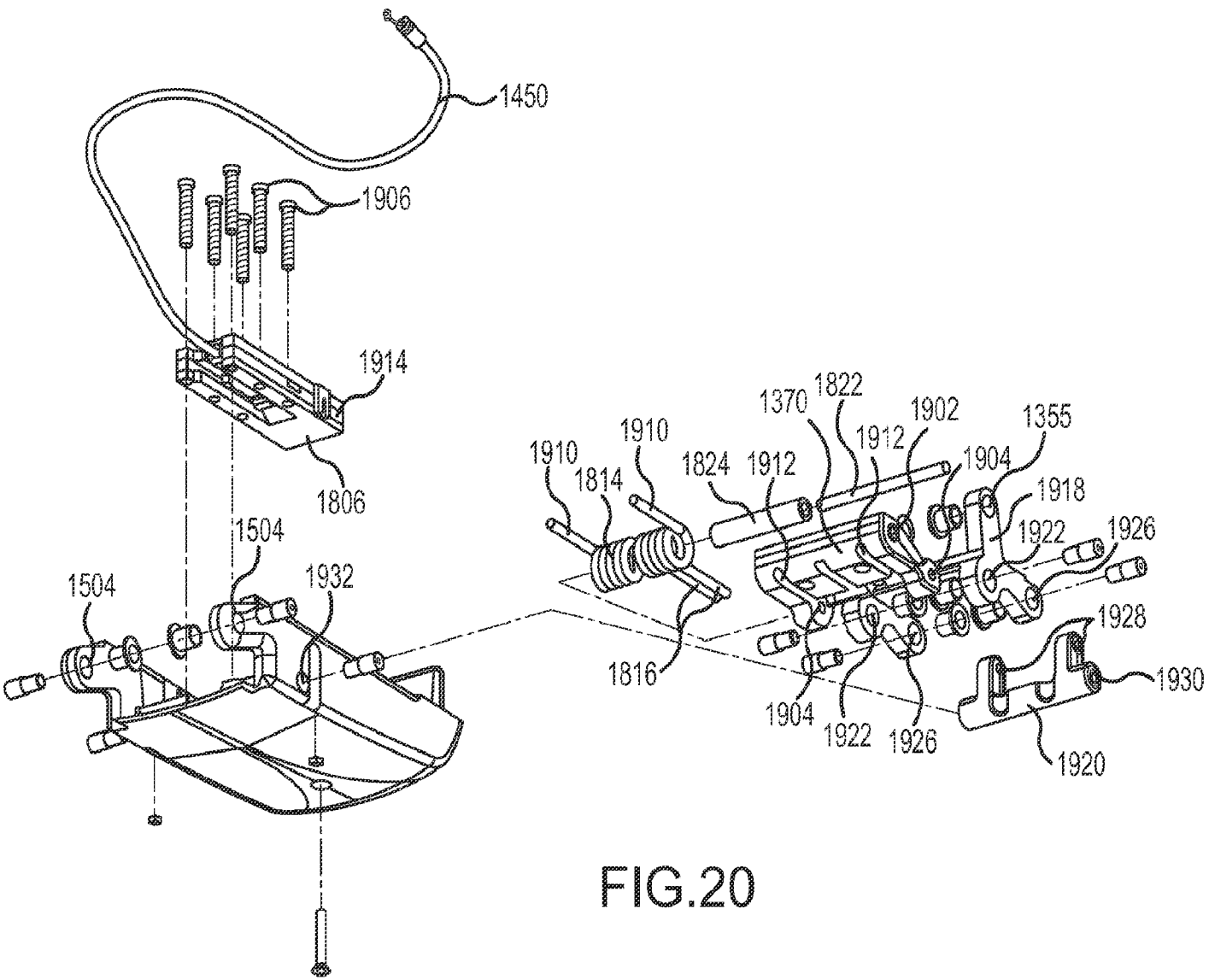
FIG. 20 illustrates another exploded perspective view of the reclining assembly of FIGS. 15-19, according to embodiments of the present invention.
Figure 21:
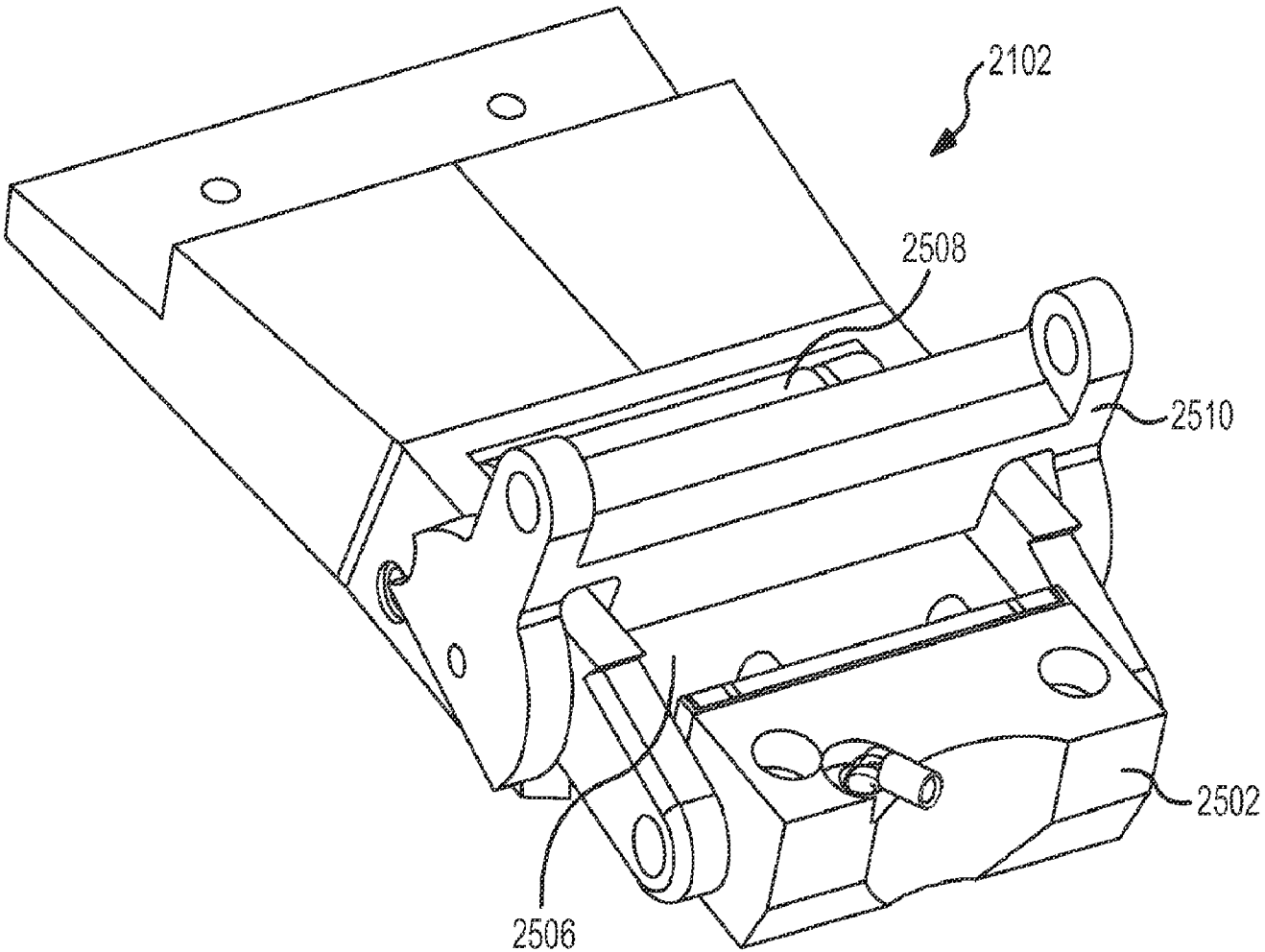
FIG. 21 illustrates a perspective view of an alternative reclining assembly, according to embodiments of the present invention.
Figure 22:
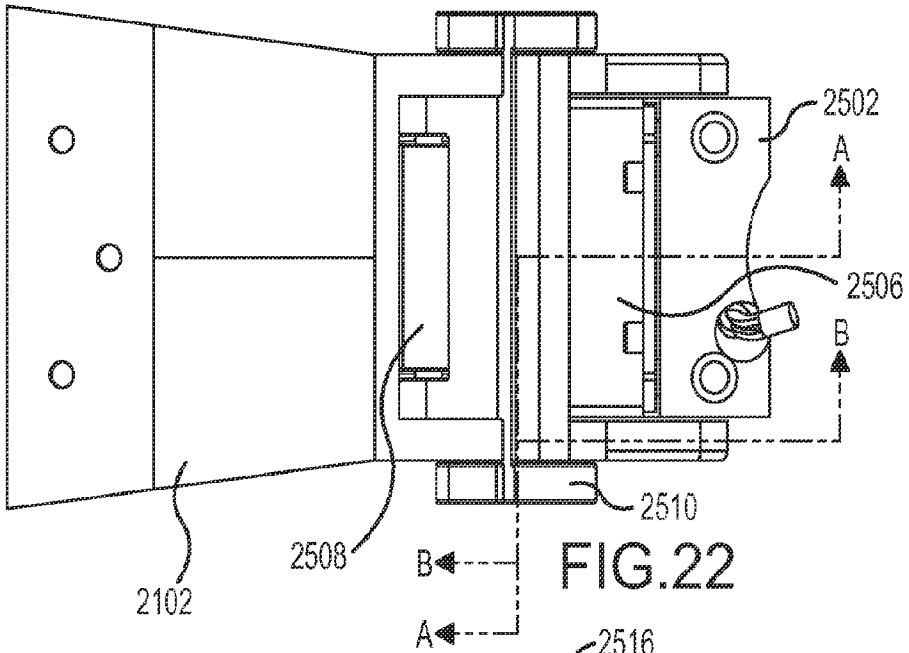
FIG. 22 illustrates a top view of the alternative reclining assembly of FIG. 21, according to embodiments of the present invention.
Figure 24:
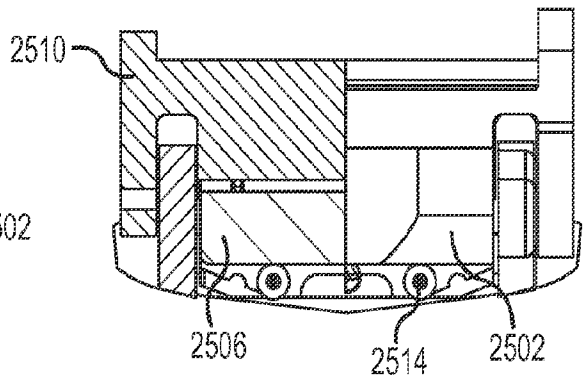
FIG. 24 illustrates a partial front cross sectional view of the alternative reclining assembly of FIGS. 21-23, taken along line A-A of FIG. 22, according to embodiments of the present invention.
Figure 23:
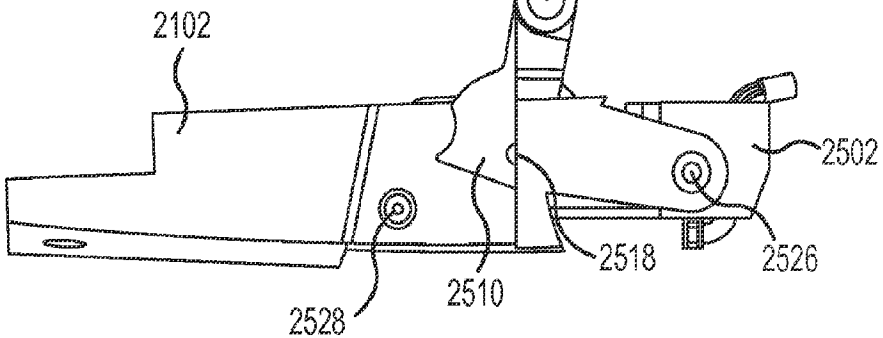
FIG. 23 illustrates a partial side cross sectional view of the alternative reclining assembly of FIGS. 21 and 22, taken along line B-B of FIG. 22, according to embodiments of the present invention.
Figure 25:
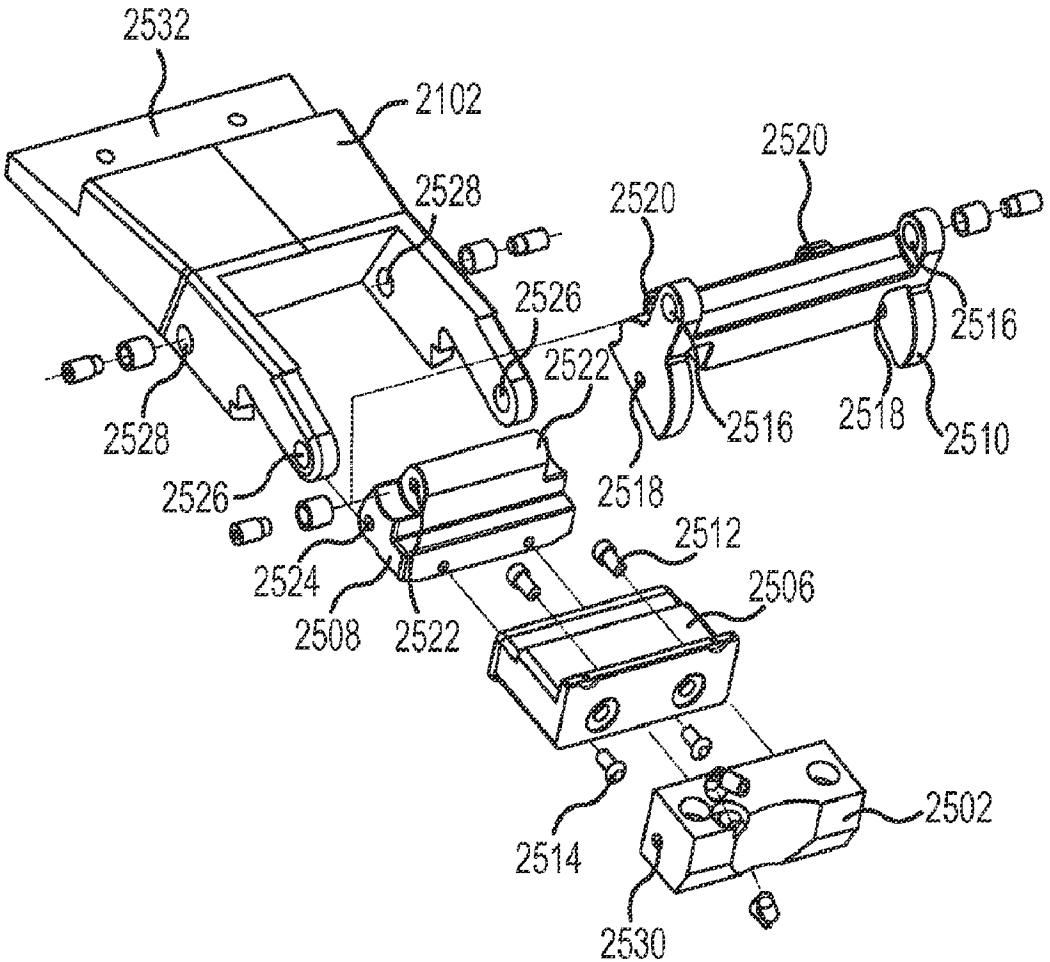
FIG. 25 illustrates an exploded perspective view of the alternative reclining assembly of FIGS. 21-24, according to embodiments of the present invention.

FIG. 18 depicts a cross-sectional side view, and FIGS. 19-20 depict exploded perspective views of reclining assembly 954. Reclining assembly is pivotably coupled by pivot points 1504 to base connector 1370 on both sides at location 1902, according to embodiments of the present invention. Base connector 1370 has mounted therein one or more (in the embodiment depicted, a pair) of torsion or coil springs 1814. Each spring 1814 includes a mounting end 1910 and a lever end 1816, according to embodiments of the present invention. Slots 1912 in base connector 1370 accept mounting ends 1910, and inner shaft 1822 passes through outer shaft 1824 which, in turn, pass through springs 1814 and mount springs 1814 to base connector 1370 at shaft connection points 1904. Lever ends 1816 extend from base connector 1370 and are accepted by slider case 1914 of reclining assembly 954.

A slider 1808 is housed between upper half 1804 and lower half 1806 of slider case 1914, and is configured to slide along tracks 1908 back and forth in a substantially horizontal linear direction as indicated by line 1812. Upper half 1804 and lower half 1806 may be bolted together and to reclining assembly 954 by screws or bolts 1906 or by other attachment means. When base connector 1370 is rotatably coupled with reclining assembly 954, lever ends 1816 of springs 1814 extend between front posts 1916 of slider case 1914 and below slider 1808. FIG. 18A depicts the reclining assembly 954 and slider 1808 in an upright and locked position, according to embodiments of the present invention. Slider 1808 is all the way forward, and reclining assembly 954 contacts spring 1814 at or near contact point 1874; according to some embodiments of the present invention, spring 1814 is preloaded such that it biases reclining assembly 954 in an upright position, such that in a fully upright position, the contact point 1810 on slider does not contact spring 1814.

According to some embodiments of the present invention, the reclining assembly 954 is most greatly biased in an upright or forward position by the occupant's weight in the upright position, which adds to the spring preload to provide back support and/or recline resistance. In the upright configuration of FIG. 18A, slider 1808 is also free to move forward and backward because it does not contact spring 1814 in that configuration, according to embodiments of the present invention. The configuration of FIG. 18A may also be characterized as a locked position, because the slider 1808 is fully forward and any attempt to recline the mechanism will cause slider 1808 to contact lock ledge 1872 which constrains further reclination.

FIG. 18B depicts slider 1808 in a high tension reclining position; the position of slider 1808 may be varied along the direction indicated by arrow 1812 between the depicted fully forward position (FIG. 18A) and a rearward position (FIG. 18C) until back end 1820 of slider 1808 abuts back inner end 1818 of lower half 1806. In the high tension position of FIG. 18B, slider 1808 is free to clear locking ledge 1872, and thus permits reclining, according to embodiments of the present invention. Once the slider 1808 is out of the locked position, applying a reclining force to reclining assembly 954 in the direction indicated by arrow 502 causes a force to be applied between slider 1808 and lever end 1816 at contact point 1810 in the direction indicated by arrow 1802. This force also lifts spring 1814 off of 1818, and recline resistance due to the occupant's weight diminishes as resistance from the spring 1814 increases, according to embodiments of the present invention. Spring 1814 thus provides resistance to the reclining force, thus permitting deflection of lever arm 1816 through an angle proportional to the length of the moment arm for a given force.

According to some embodiments of the present invention, moving slider 1808 to a more forward position as depicted in FIG. 18B applies the reclining force over a shorter moment arm, which causes spring 1814 to permit a smaller reclining angle for a given force; moving slider 1808 to a rearward position as depicted in FIG. 18C applies the reclining force over a longer moment arm, which causes spring 1808 to permit a larger reclining angle for a given force. According to some embodiments of the present invention, for a given recline, the angular displacement is greater when the slider 1808 is in the high tension position and smaller when the slider 1808 is in the low tension position. Thus, a user may select a customized reclining angle and/or spring resistance by selecting a position for slider 1808 between a forward position and rearward position, inclusive, according to embodiments of the present invention. Based on the disclosure provided herein, one of ordinary skill in the art will recognize that various reclining angles and levels of resistance may be achieved by varying the shape, geometry, and spring constant characteristics of spring 1814. According to some embodiments of the present invention, the backward reclining angle is limited by the bottom lip 1868 of reclining assembly 954 abutting against the base 950.

According to embodiments of the present invention, the resistive element of reclining assembly 954 is not pre-loaded against the adjustment slider 1808. In other words, the force required to adjust the reclining angle and/or reclining resistance is on the order of magnitude of the force required to slide slider 1808 along tracks 1908, rather than a force on the order of magnitude of the force required to adjust the tension of a spring. Applying this smaller force over a smaller distance results in much less work required to adjust the reclining angle and/or resistance, which makes chair 100 more easy to use, especially for those with a limited range of strength and dexterity. According to some embodiments of the present invention, slider 1808 may be biased in another position, and/or additional springs may be used to further facilitate linear movement of slider 1808. According to some embodiments of the present invention, springs 1857 may allow tension adjust lever 2602 to be moved when chair 100 is reclined and a spring load on slider 1808 prevents it from moving; upon sitting upright and relieving the spring load on slider 1808, such springs 1857 bias the slider to the newly selected tension position.

Additional linkages couple base connector 1370 with reclining assembly 954, according to embodiments of the present invention. Linkage 1918 is rotatably coupled with seat mount 952 at pivot points 1355. Linkage 1918 is also rotatably coupled with base connector 1370 by rotatably coupling pivot points 1922 with pivot points 1924, according to embodiments of the present invention. Furthermore, linkage 1918 is rotatably coupled with linkage 1920 by rotatably coupling pivot points 1926 with pivot points 1928, according to embodiments of the present invention. Finally, linkage 1920 is rotatably coupled with reclining assembly 954 by rotatably coupling pivot points 1930 with pivot points 1932, according to embodiments of the present invention.

According to embodiments of the present invention, chair 100 is thus given a particular motion upon reclining defined by a six-bar mechanism for motion in a plane substantially parallel to the plane defined by lines V1 and H2 of FIGS. 2, 5 and 6. According to embodiments of the present invention, chair 100 includes a Watt's sixbar inversion 11 mechanism for movement in such plane. According to embodiments of the present invention, the six linkages and seven pivot points may be identified as follows: The first linkage is the base 950 and thus also the base connector 1370 which is affixed to base 950. The second linkage comprises the front linkage 958 (and it's counterpart front linkage 956 which may be viewed as the same linkage in two dimensions) which pivots about base 950 at first pivot point 1360. The third linkage is seat mount 952 which pivots about front linkage 958 at second pivot point 1350. The fourth linkage is linkage assembly 954 and back 102, which pivot about base connector 1370 at third pivot point 1504. The fifth linkage is linkage 1918 which pivots about seat mount 952 at fourth pivot point 1355 and which pivots about base connector 1370 at fifth pivot point 1922. The sixth linkage is linkage 1920 which pivots about linkage 1918 at sixth pivot point 1926 and which pivots about linkage assembly 954 at seventh pivot point 1932. According to such embodiments, resistance (in the form of springs 1814) is provided for the third pivot point (1504) between the fourth linkage (linkage assembly 954) and the first linkage (base connector 1370).

Figure 32:
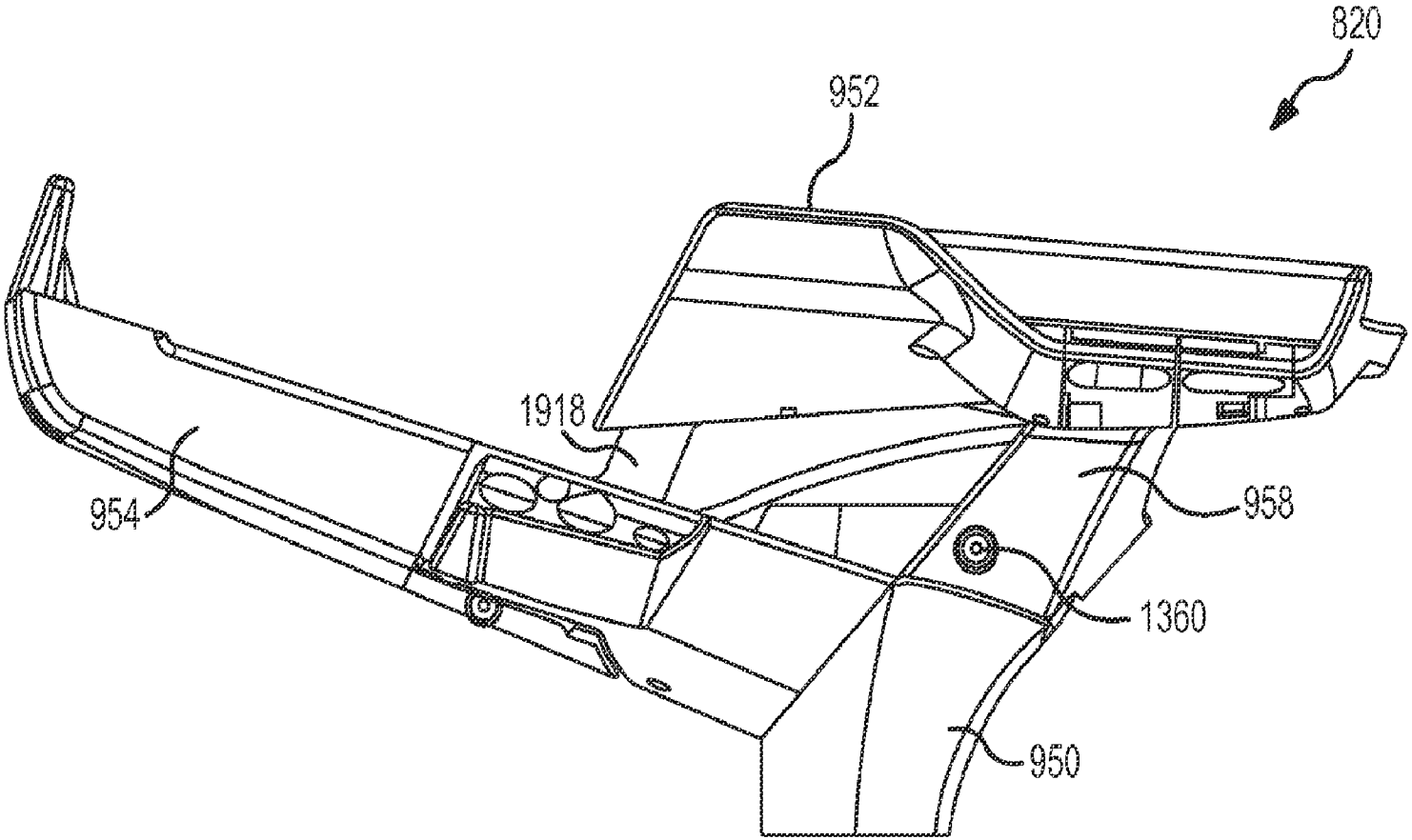
FIG. 32 illustrates side view of a core assembly in a reclined position, according to embodiments of the present invention.
Figure 33:
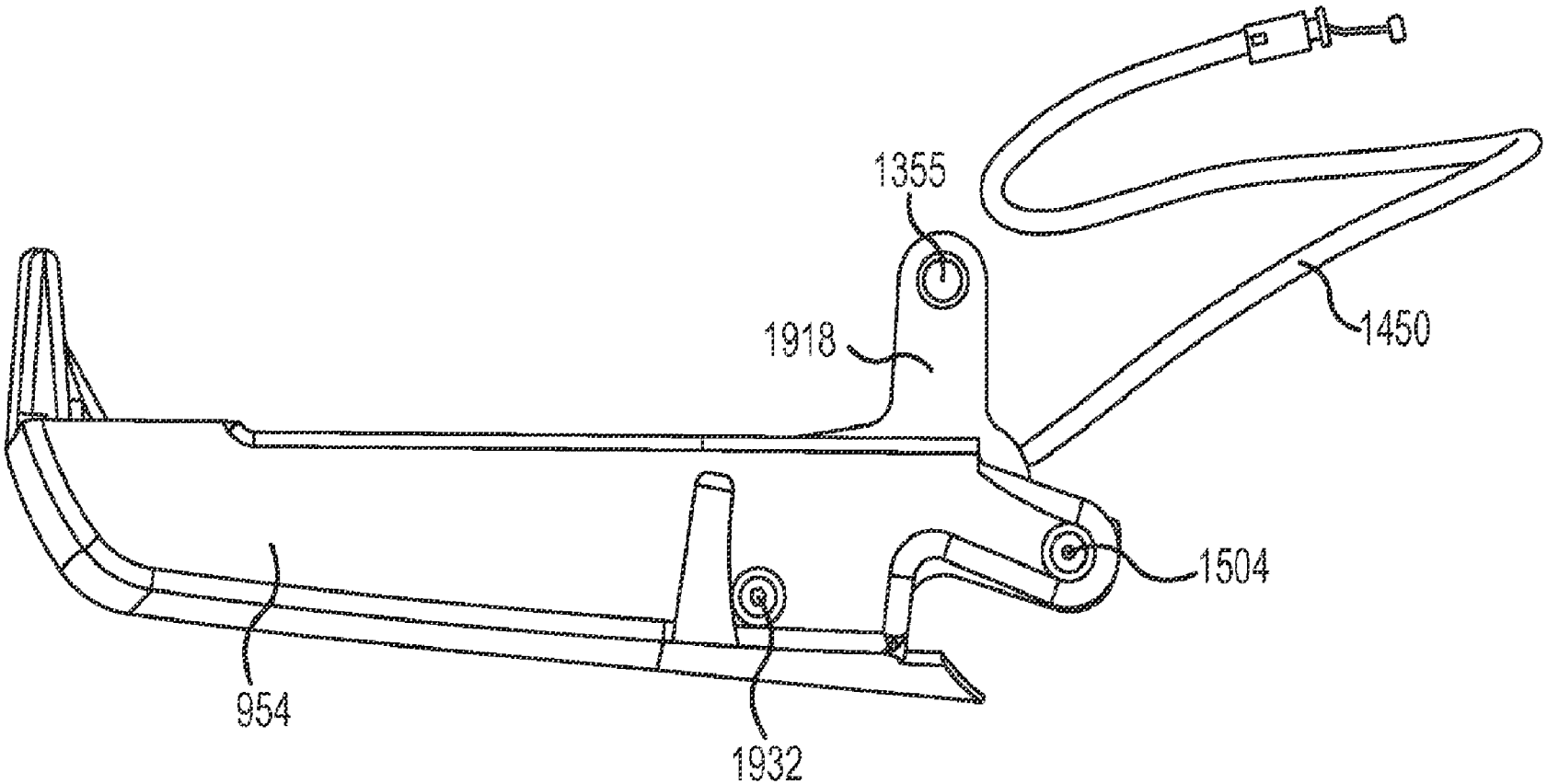
FIG. 33 illustrates a side view of a reclining assembly in a reclined position, according to embodiments of the present invention.
Figure 34:
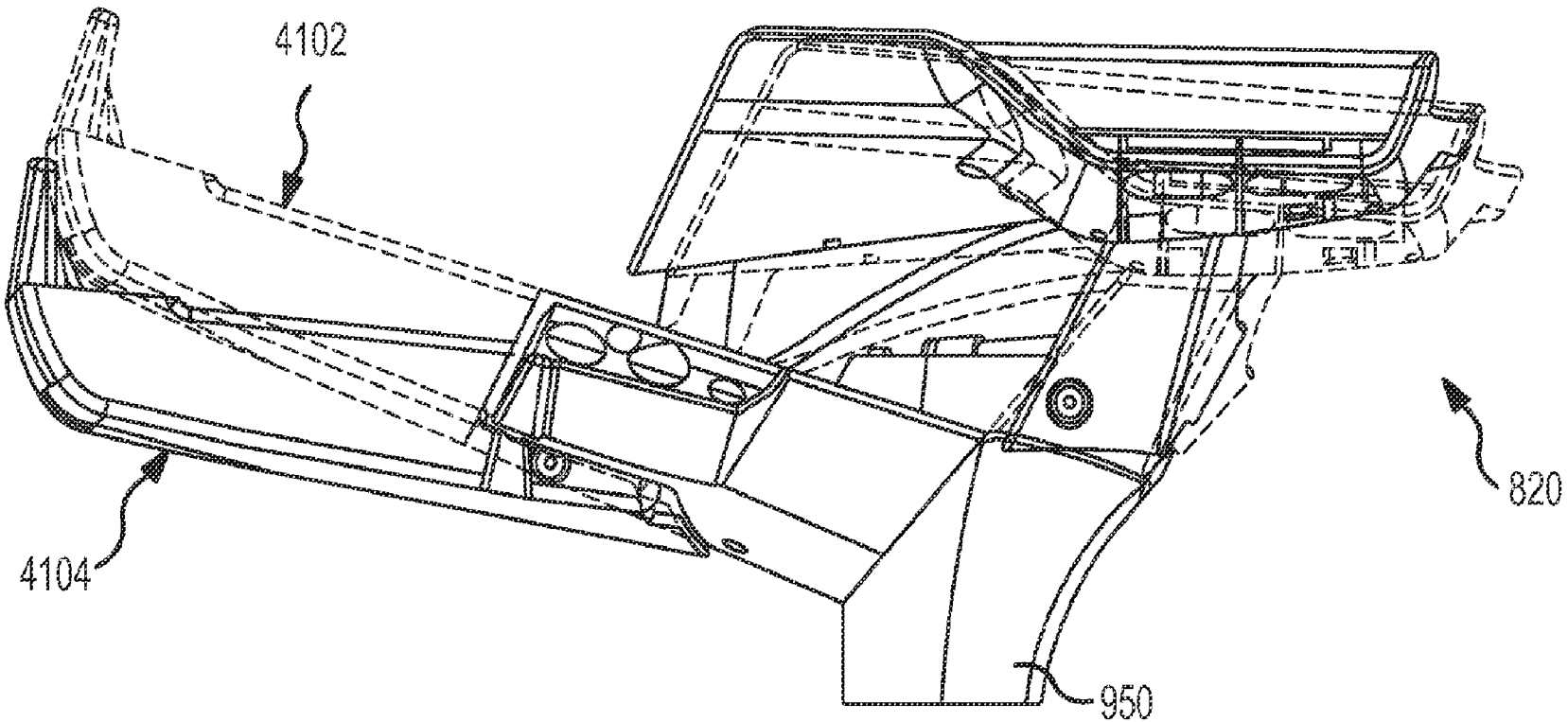
FIG. 34 illustrates a side view of the core assembly of FIG. 32 with an upright position in broken lines superimposed upon a reclined position in solid lines, according to embodiments of the present invention.

FIG. 32 illustrates a core assembly 820 in an upright position, according to embodiments of the present invention. Reclining assembly 954 and seat mount 952 are depicted in a reclined position with respect to base 950, according to embodiments of the present invention. FIG. 33 illustrates a reclining assembly 954 with its various linkages (including linkage 1918) in a reclined position after rotation about pivot points 1355, 1504, 1932, according to embodiments of the present invention. FIG. 34 illustrates a core assembly 820 depicted in broken lines in an upright position 4102 superimposed upon a chair 100 depicted in solid lines in a reclined position 4104 about base 950, according to embodiments of the present invention.

FIGS. 21-25 depict an alternative embodiment of a reclining assembly 2102. Similar to reclining assembly 954, reclining assembly 2102 is pivotably coupled to base connector 2502 at pivot points 2530. Base connector 2502 may be affixed to base 950 such that it may be treated as the same linkage as base 950, according to embodiments of the present invention. Back 102 may also be affixed to reclining assembly 2102 at back attachment point 2532. Linkage 2510 is rotatably coupled with seat mount 952 at pivot points 2516, and is rotatably coupled with base 950 at pivot points 2518. Linkage 2510 is also rotatably coupled with linkage 2508 by rotatably coupling pivot points 2520 with pivot points 2522. Linkage 2508 is rotatably coupled to reclining assembly 2102 by rotatably coupling pivot point 2524 with pivot point 2528, according to embodiments of the present invention.

A rubber spring element 2506 may be coupled with base connector 2502 by screws 2512 or other attachment means, and may be coupled with linkage 2508 by screws 2514 or other attachment means, according to embodiments of the present invention. As chair 100 is reclined, reclining assembly 2102 rotates about pivot points 2530, thus bending rubber spring element 2506. Accordingly, rubber spring element 2506 serves to provide reclining resistance to the motion of reclining assembly 2102 about pivot point 2530, according to embodiments of the present invention. According to some embodiments of the present invention, in addition to the bending of rubber spring element 2506, linkage 2510 may be configured to press downwardly on rubber spring element 2506 upon reclining, such that rubber spring element 2506 provides reclining resistance in both bending and shear modalities. According to some embodiments of the present invention, such a load resistance mechanism is non-preloaded, such that sliding an adjustable slider (not shown) underneath rubber spring element 2506 changes the length of rubber spring element 2506 which is subject to bending and/or shearing, which effectively permits a user to select a desired amount of resistance and/or a desired reclining angle by sliding a slider along the underside of the working portion of rubber spring element 2506.

Figure 4:
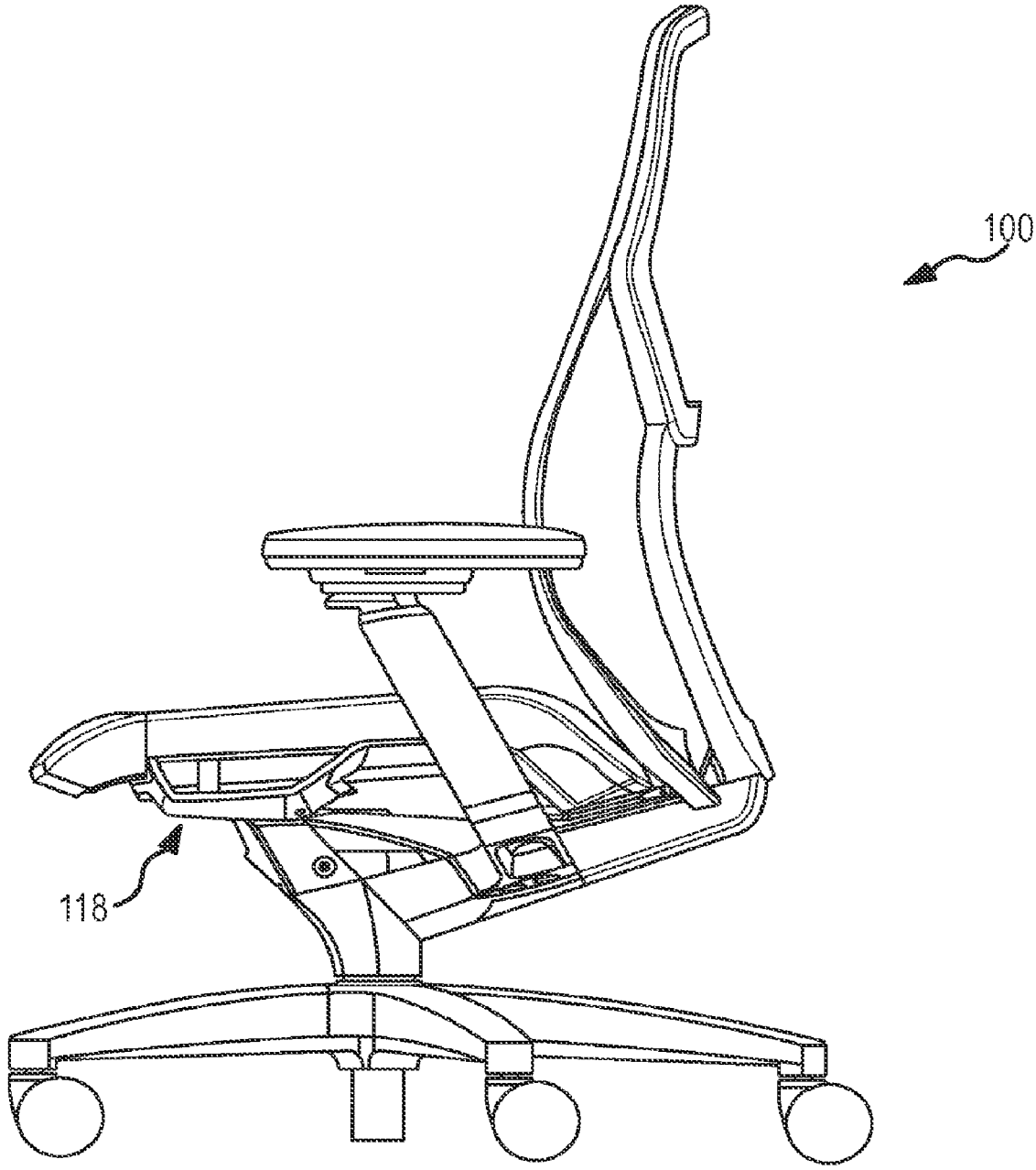
FIG. 4 illustrates a side view of the chair of FIGS. 1-3, according to embodiments of the present invention.
Figure 26:
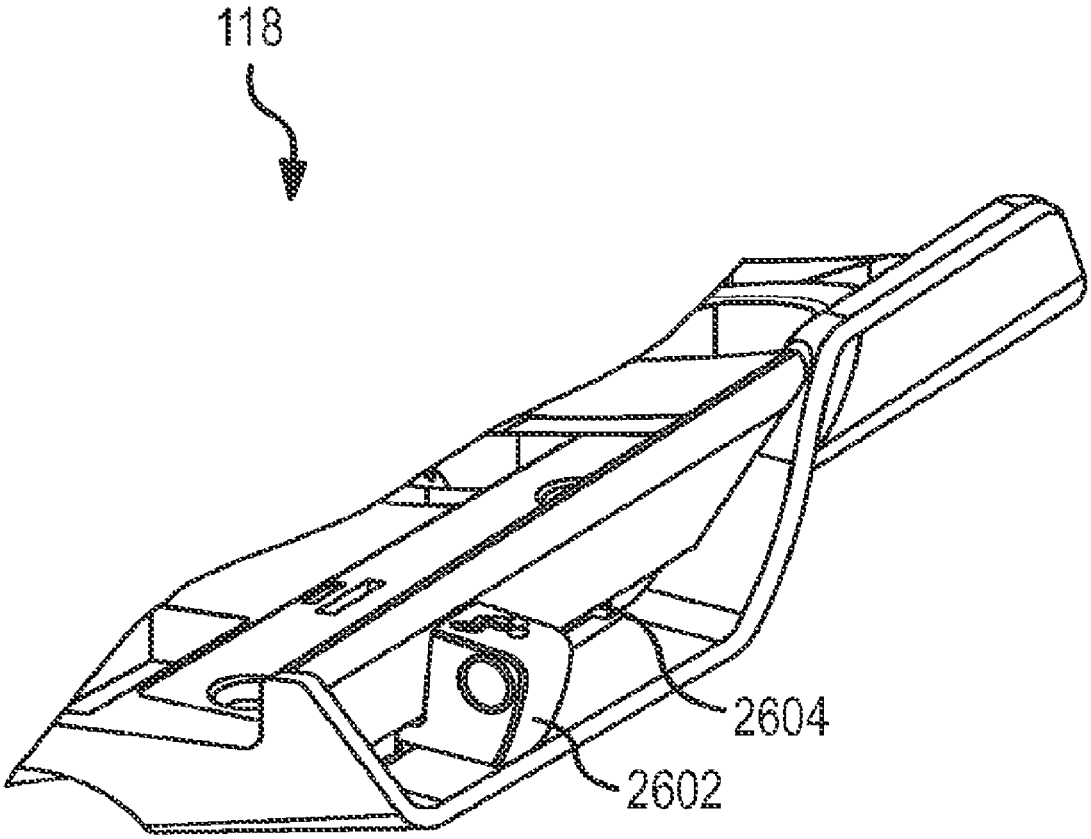
FIG. 26 illustrates a perspective view of a resistance control pod, according to embodiments of the present invention.
Figure 27A:
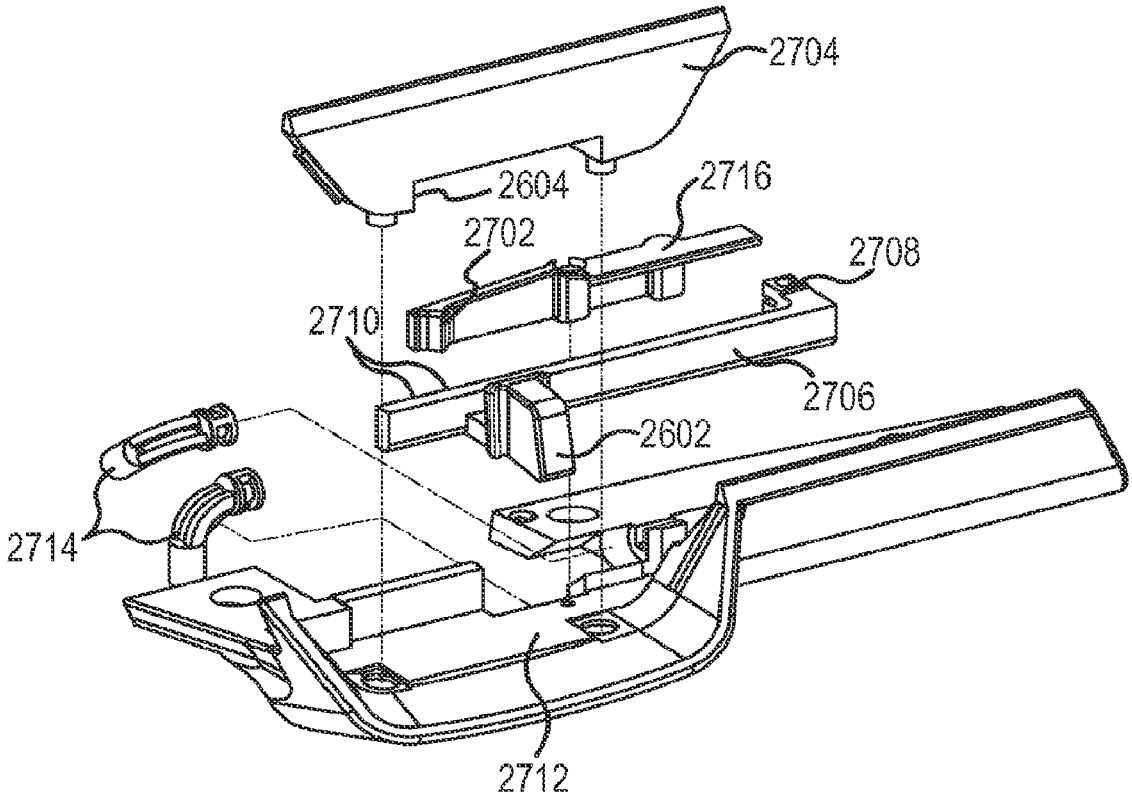
FIG. 27A illustrates an exploded perspective view of an embodiment of a resistance control pod.
Figure 27B:
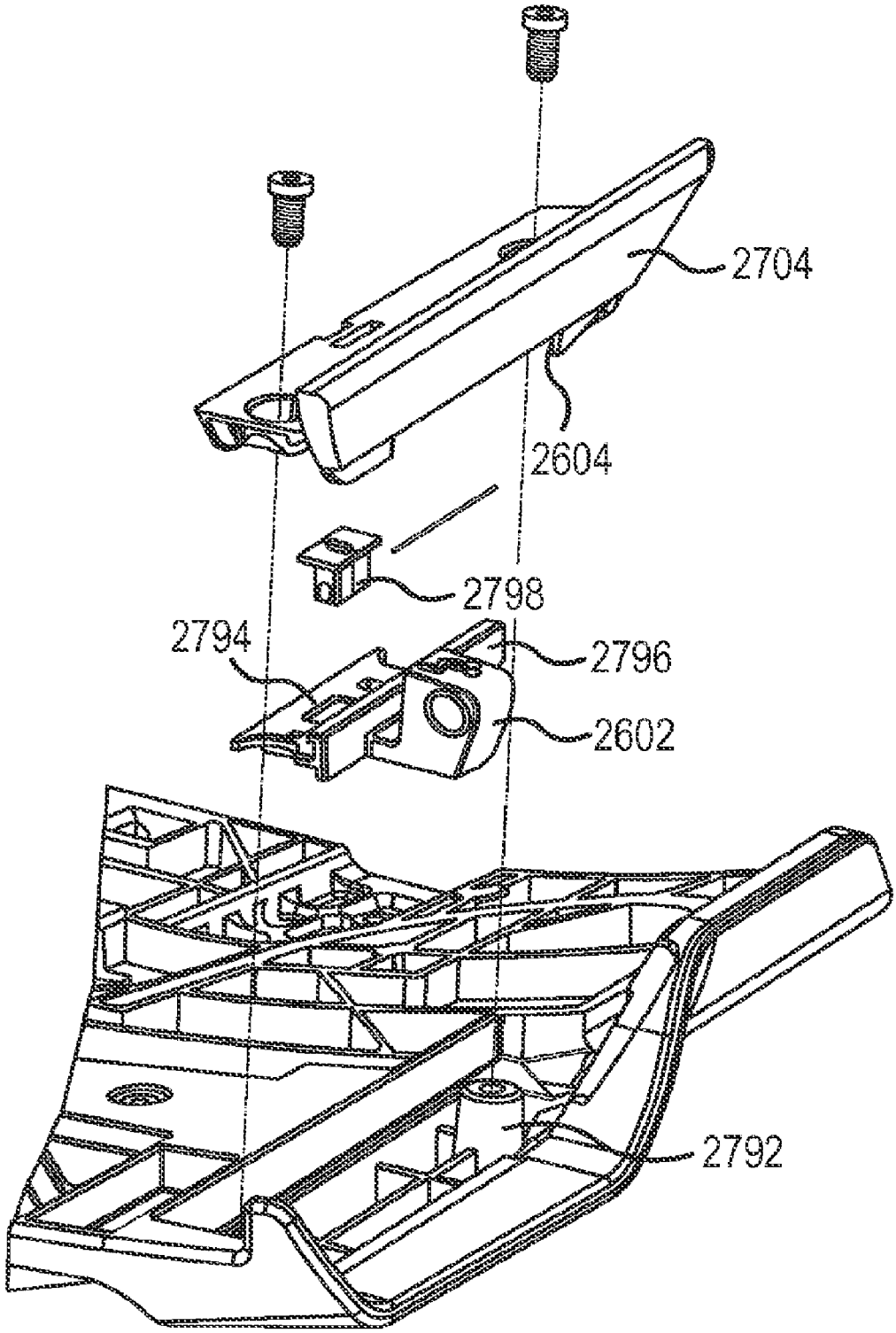
FIG. 27B illustrates an exploded perspective view of the resistance control pod of FIG. 26, according to embodiments of the present invention.

FIGS. 26-27B illustrate a resistance control pod 118 according to embodiments of the present invention. Resistance control pod 118 may be located directly below seat 104, as illustrated in FIGS. 1 and 4; this placement permits a user to easily adjust the resistance of the reclining assembly 954 without having to bend over and reach far underneath the chair. Resistance control pod 118 translates a back and forth motion of button 2602 within slot 2604 into the back and forth linear adjustment of slider 1808 as described above with respect to FIGS. 18-20. As described above, because the resistance adjustment mechanism is non-preloaded and/or not significantly preloaded, the only work required to adjust the resistance and/or reclining angle is the work required to slide button 2602 which, in turn, slides slider 1808, according to embodiments of the present invention.

According to various embodiments of the present invention, button 2602 is coupled with slider 2706 such that sliding button 2602 slides slider 2706; insert plate 2704 has button slot 2604 formed therein and may be affixed to resistance control base plate 2712, as illustrated in FIG. 27A. Support piece 2716 may be affixed to resistance control base plate 2712 and includes a beak portion 2702 configured to interface with a set of teeth 2710 formed on slider 2706. Beak portion 2702 is configured to provide minimal resistance by interfacing with teeth 2710 to prevent inadvertent resistance adjustment; according to some embodiments of the present invention, beak portion 2702 makes a slight clicking noise as button 2602 slides from one position to another. A cable 1450 (see FIGS. 13 & 15-20) may be attached to slider 2706 at cable attachment mechanism 2708 such that sliding the button 2602 causes the control cable to be pushed or pulled. The control cable 1450 may be a steel cable, for example, and may also include an outer sheath to further facilitate placement and/or operation of the control cable 1450. Cable elbows 2714 may be used to change the direction of the control cable 1450 to guide the control cable 1450 through chair 100 and ultimately to slider 1808. FIG. 18 depicts where the other end 1890 of the control cable 1450 emerges; for example, the outer sheath of the control cable 1450 may be mounted to slider case 1914 and the control cable 1450 may be coupled with slider 1808. FIG. 9 illustrates a cable channel 902 formed within seat mount 952 through which the control cable 1450 may be routed from resistance control 118 to slider case 1914, according to embodiments of the present invention.

According to an alternative embodiment of the present invention as illustrated in FIG. 27B, a cable grip 2798 may be placed through an aperture 2794 in a slider 2796 coupled with the button 2602. Insert plate 2704 may be coupled to base plate 2792, permitting slider 2796 to slide back and forth between attachment pillars 2792 upon actuation of the button 2602, according to embodiments of the present invention.

According to such an embodiment, the teeth for providing minor resistance to the actuation of button 2602 may be located on the slider 1808 itself (see FIG. 19), rather than at resistance control pod 118.

Figure 28:
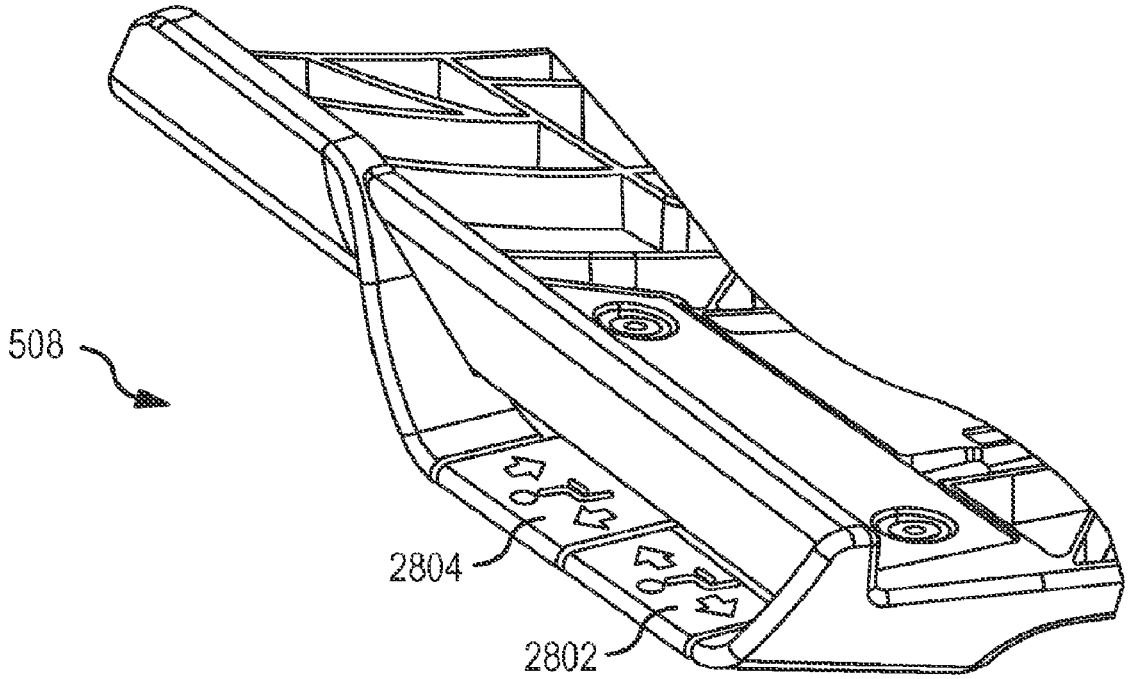
FIG. 28 illustrates a perspective view of a seat control pod according to embodiments of the present invention.
Figure 29:
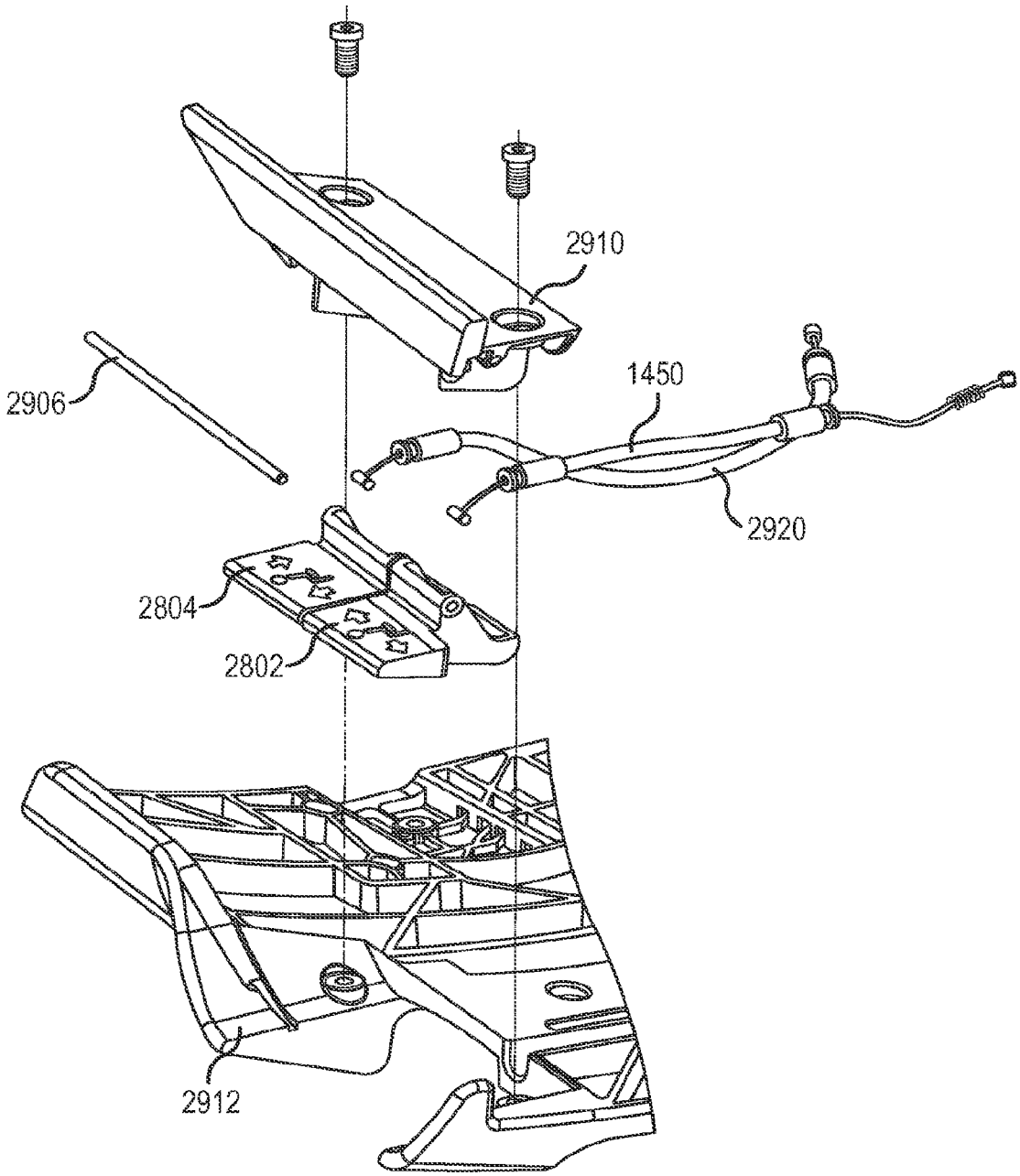
FIG. 29 illustrates an exploded perspective view of the seat control pod of FIG. 28, according to embodiments of the present invention.

FIGS. 28-29 depict a seat control pod 508 according to embodiments of the present invention. Button 2802 may be used to control the forward and backward sliding of seat 104 along seat mount 952, and button 2804 may be used to control the upward and downward motion of seat 104 with respect to pedestal 110. Buttons 2802 and 2804 may include a spindle 2906 which are mounted on or within an insert 2910 which may then be affixed to the seat control pod base 2912 and about which buttons 2802 and 2804 rotate. Similar to resistance control pod 118, seat control pod 508 may be located directly below seat 104, as illustrated in FIG. 5; this placement permits a user to easily adjust the seat 104 position without having to bend over and reach far underneath the chair. According to some embodiments of the present invention, cable attachment mechanisms (not shown) at the back of each button 2802, 2804 attach to control cables which may be pulled by lifting the buttons 2802, 2804 to cause them to rotate about spindles 2906. For example, button 2804 controls a cable 2920 which is coupled to hydraulic piston 826; lifting button 2804 may be configured to activate hydraulic piston 826 to raise seat 104 in the absence of a user's weight.

Figure 31:
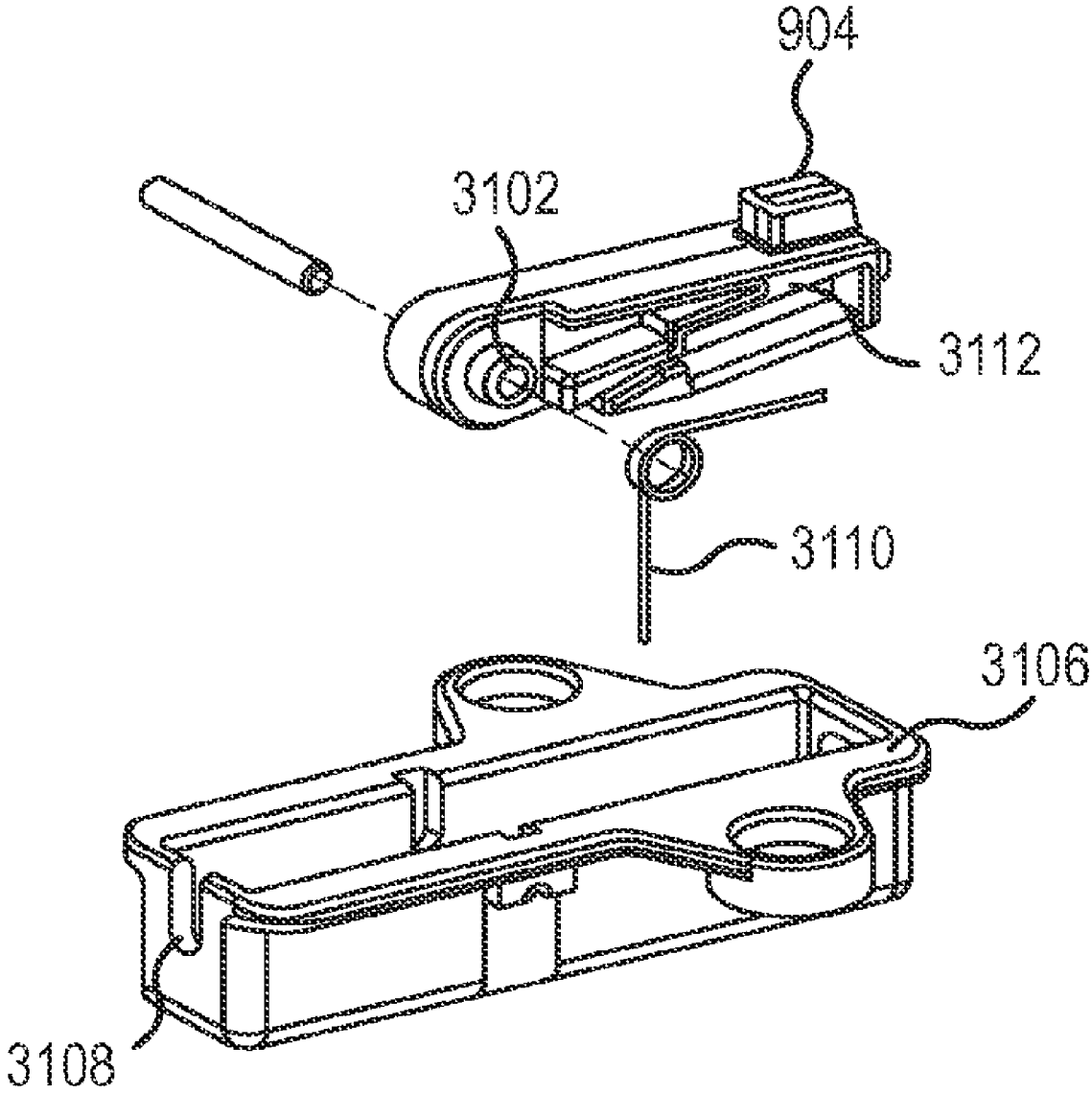
FIG. 31 illustrates an exploded perspective view of a seat latch and housing element, according to embodiments of the present invention.

According to embodiments of the present invention, button 2802 may be attached to a control cable 1450 or a control rod which is coupled to a seat latch 904 (see FIGS. 9 and 31). For example, seat latch 904 may be mounted within a seat latch housing 3106 such that seat latch 904 rotates about pivot axis 3102 with respect to housing 3106. The control cable or control rod may enter housing 3106 through entry port 3108 and couple to lever 3112. Such a configuration causes seat latch 904 to rotate to a recessed position within housing 3106 upon a motion of the control cable or control rod pulling outward through housing 3106 and through entry port 3108, according to embodiments of the present invention. The lifting of button 2802 rotates button 2802 about spindle 2906 and pulls the control cable or control rod, thereby pulling the seat latch 904 to a recessed position. According to some embodiments of the present invention, a spring 3110 or other biasing element may be coupled with the control cable or control rod to pull seat latch 904 back into the raised position in the absence of a lifting of button 2802.

Figure 30:
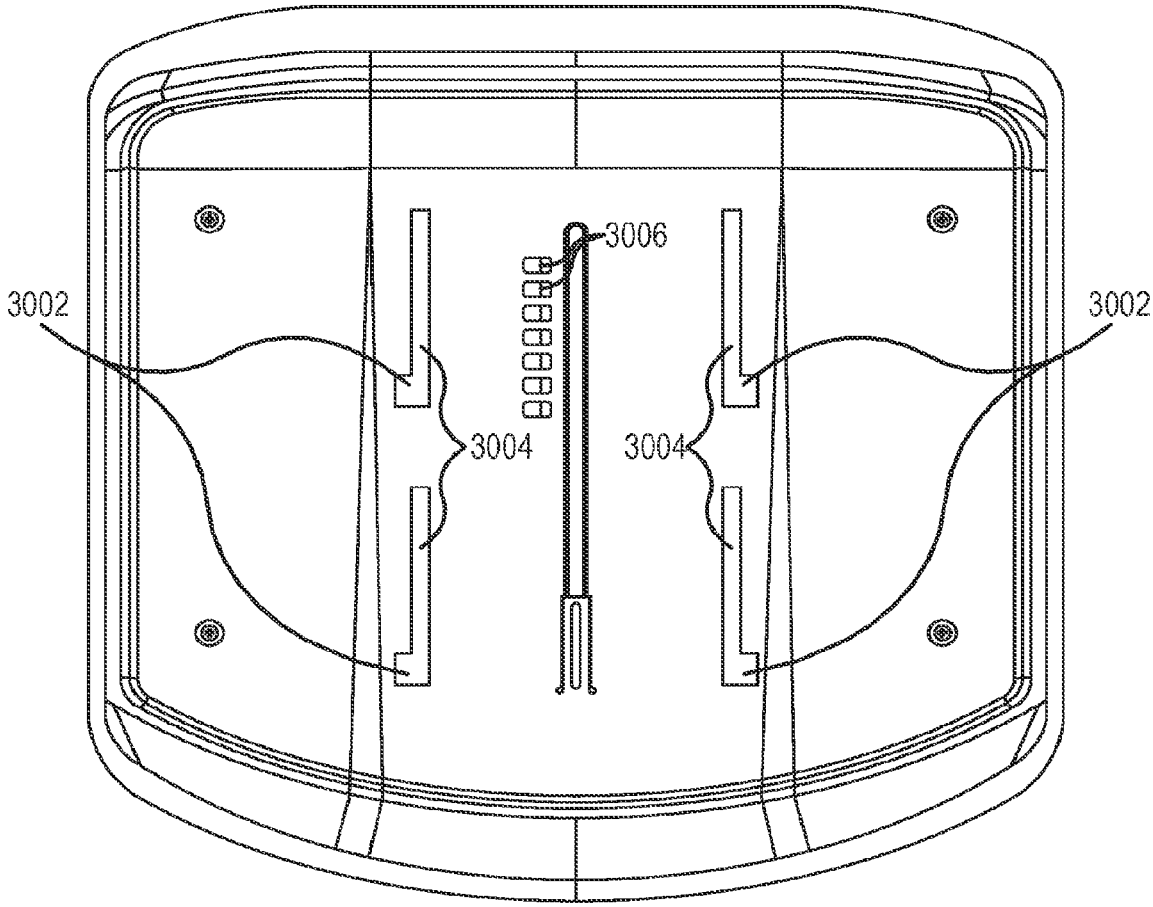
FIG. 30 illustrates a bottom view of a seat according to embodiments of the present invention.

FIG. 30 illustrates a bottom view of seat 104, in which various slots are formed. Slots 3002 are configured to receive tabs 906 which are formed on seat mount 952 (see FIG. 9) and slots 3004 permit seat 104 to slide along tabs 906, according to embodiments of the present invention. Slots 3006 are sized to receive seat latch 904. When button 2802 is lifted and seat latch 904 is in a recessed position, seat 104 is free to slide along tabs 906 over the length of slots 3004. When button 2802 is released, seat latch 904 resumes a raised position and contacts and protrudes within one of the slots 3006, preventing further sliding of seat 104. In this way, a user may select a desired seat 104 position by lifting button 2802, sliding the seat 104 to a desired position corresponding to one of slots 3006, and releasing button 2802 to lock the seat in place, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A chair comprising:

a base;

a first linkage pivotably coupled to the base;

a seat pivotably coupled to the first linkage;

a second linkage pivotably coupled to the seat and pivotably coupled to the base;

a back comprising a substantially upright portion and an attachment portion, the attachment portion pivotably coupled to the base at a first pivot point; and a third linkage pivotably coupled to the back at a second pivot point and pivotably coupled to the second linkage, wherein the second pivot point is located on the attachment portion between the first pivot point and the substantially upright portion.

2. The chair of claim 1, wherein the back reclines about the first pivot point, the chair further comprising:

a biasing element configured to apply a resistance force about the first pivot point, the resistance force resisting a reclining force of the back.

3. The chair of claim 2, wherein the biasing element is a coil spring.

4. The chair of claim 3, wherein the coil spring comprises a lever arm, and wherein the resistance force is adjustable by varying a location along the lever arm at which the reclining force is applied to the coil spring.

5. The chair of claim 4, further comprising:

a slider configured to transmit the reclining force from the back to the lever arm.

6. The chair of claim 5, wherein the slider slides substantially horizontally along the lever arm, and wherein a sliding force for sliding the slider is substantially less than the resistance force.

7. The chair of claim 5, wherein the slider slides between a locked position and an unlocked position, and wherein the slider in the locked position substantially prevents reclining of the back about the base.

8. The chair of claim 7, wherein the slider in the locked position is in a position closest to the seat.

9. The chair of claim 5, further comprising:

a cable sheath having a first end and a second end, the cable sheath coupled to the base; and a cable extending through the cable sheath and slidable within the cable sheath, a first portion of the cable extending from the first end of the cable sheath, the first portion coupled to the slider, and a second portion of the cable extending from the second end of the cable sheath, wherein sliding the second portion into and out of the cable sheath slides the slider back and forth along the lever arm.

10. The chair of claim 9, further comprising:

a button coupled to the second portion and configured to slide the second portion into and out of the cable sheath.

11. The chair of claim 10, wherein the lever is mounted to the seat.

12. The chair of claim 10, wherein the lever is mounted directly below the seat on a user's left or right side when the user sits in the seat.

13. The chair of claim 2, wherein the resistance force is adjustable by varying a location along the biasing element at which the reclining force is applied.

14. The chair of claim 13, further comprising:

a slider configured to transmit the reclining force from the back to the biasing element.

15. The chair of claim 14, wherein the slider slides substantially horizontally along the biasing element, and wherein a sliding force for sliding the slider is substantially less than the resistance force.

16. The chair of claim 15, further comprising:

a cable sheath having a first end and a second end, the cable sheath coupled to the base; and a cable extending through the cable sheath and slidable within the cable sheath, a first portion of the cable extending from the first end of the cable sheath coupled to the slider, and a second portion of the cable extending from the second end of the cable sheath, wherein sliding the second portion into and out of the cable sheath slides the slider back and forth along the biasing element.

17. The chair of claim 16, further comprising:

a lever coupled to the second portion and configured to slide the second portion into and out of the cable sheath.

18. The chair of claim 1, wherein the base, the seat, the back, and the first, second, and third linkages comprise a Watts sixbar inversion II mechanism.

19. The chair of claim 1, wherein the seat is configured to move upwardly and toward the back when the back reclines about the base.

20. The chair of claim 1, wherein the back reclines about the base from a fully upright position to a fully reclined position, and wherein a centrode of the back with respect to the seat remains above the seat as the back reclines from the fully upright position to the fully reclined position.

21. The chair of claim 20, wherein the centrode substantially coincides with a hip point of a user sitting in the chair as the back reclines from the fully upright position to the fully reclined position.

22. A chair comprising:

a base;

a first linkage pivotably coupled to the base at a first pivot point;

a seat pivotably coupled to the first linkage at a second pivot point;

a second linkage pivotably coupled to the seat at a third pivot point and pivotably coupled to the base at a fourth pivot point;

a back pivotably coupled to the base at a fifth pivot point; and a third linkage pivotably coupled to the back at a sixth pivot point and pivotably coupled to the second linkage at a seventh pivot point, wherein the third, fourth, and seventh pivot points are not substantially collinear.

23. A chair comprising:

a base;

a first linkage pivotably coupled to the base at a first pivot point;

a seat pivotably coupled to the first linkage at a second pivot point;

a second linkage pivotably coupled to the seat at a third pivot point and pivotably coupled to the base at a fourth pivot point;

a back pivotably coupled to the base at a fifth pivot point; and a third linkage pivotably coupled to the back at a sixth pivot point and pivotably coupled to the second linkage at a seventh pivot point, wherein the back reclines about the base from a fully upright position to a fully reclined position, and wherein the second pivot point of the first linkage does not rotate over-center with respect to the first pivot point of the first linkage and the third pivot point of the second linkage does not rotate over-center with respect to the fourth pivot point of the second linkage as the back reclines from a fully upright position to a fully reclined position.

24. The chair of claim 23, wherein a centrode of the back with respect to the seat remains above the seat as the back reclines from the fully upright position to the fully reclined position.

25. The chair of claim 24, wherein the centrode substantially coincides with a hip point of a user sitting in the chair as the back reclines from the fully upright position to the fully reclined position.

26. The chair of claim 23, wherein the second pivot point and the third pivot point rise vertically throughout reclining of the back from the fully upright position to the fully reclined position.

* * * * *